US008888600B2

(12) United States Patent
Nguyen et al.

(10) Patent No.: US 8,888,600 B2
(45) Date of Patent: Nov. 18, 2014

(54) EMULATION METHODS AND DEVICES FOR A GAMING MACHINE

(75) Inventors: Binh Nguyen, Reno, NV (US); John Goodman, Reno, NV (US); Wai Chan, Reno, NV (US)

(73) Assignee: IGT, Las Vegas, NV (US)

( * ) Notice: Subject to any disclaimer, the term of this patent is extended or adjusted under 35 U.S.C. 154(b) by 2239 days.

(21) Appl. No.: 11/205,619

(22) Filed: Aug. 15, 2005

(65) Prior Publication Data

US 2006/0046819 A1 Mar. 2, 2006

(51) Int. Cl.
*A63F 9/24* (2006.01)
*G07F 17/32* (2006.01)

(52) U.S. Cl.
CPC ..... *G07F 17/3206* (2013.01); *G07F 17/323* (2013.01); *G07F 17/32* (2013.01); *G07F 17/3202* (2013.01)
USPC ..... 463/43

(58) Field of Classification Search
CPC ..... G07F 17/32; A63F 2300/209
USPC ..... 463/16–20, 24, 25, 29, 40–43, 45, 47
See application file for complete search history.

(56) References Cited

U.S. PATENT DOCUMENTS

| | | | | |
|---|---|---|---|---|
| 5,523,948 | A | 6/1996 | Adrain | |
| 5,697,482 | A | 12/1997 | Orus et al. | |
| 5,960,190 | A | 9/1999 | MacKenna | |
| 6,379,246 | B1 | 4/2002 | Dabrowski | |
| 6,439,996 | B2 | 8/2002 | LeMay et al. | |
| 6,622,185 | B1 | 9/2003 | Johnson et al. | |
| 6,672,963 | B1 * | 1/2004 | Link | 463/43 |
| 6,716,103 | B1 * | 4/2004 | Eck et al. | 463/45 |
| 6,852,031 | B1 | 2/2005 | Rowe | |
| 6,979,266 | B2 | 12/2005 | LeMay et al. | |
| 2002/0025850 | A1 | 2/2002 | Hafezi | |
| 2002/0045484 | A1 * | 4/2002 | Eck et al. | 463/42 |
| 2002/0138594 | A1 * | 9/2002 | Rowe | 709/219 |
| 2002/0144115 | A1 | 10/2002 | LeMay et al. | |
| 2003/0037030 | A1 * | 2/2003 | Dutta et al. | 707/1 |

(Continued)

FOREIGN PATENT DOCUMENTS

| | | |
|---|---|---|
| AU | 2005204245 | 1/2011 |
| CN | 101238494 | 8/2008 |

(Continued)

OTHER PUBLICATIONS

Harris, Craig. Hoyle Casino—Game Boy Color Review at IGN, Oct. 25, 2000, IGN. p. 1-3. http://gameboy.ign.com/articles/164/164559p1.html.*

(Continued)

*Primary Examiner* — Paul A D'Agostino
(74) *Attorney, Agent, or Firm* — Foley & Lardner LLP

(57) ABSTRACT

The invention provides numerous methods and devices for enhancing the use of gaming machines. Some embodiments of the invention provide enhanced functionality for legacy gaming machines. Alternative embodiments of the invention may be implemented in an entirely new gaming machine and/or in gaming machines that are not yet in existence. Some such implementations are directed to the use of non-native gaming software in gaming machines that include (a) different peripheral devices and/or (b) a different CPU from that of the gaming machine for which the gaming software was written. These implementations may use software emulation and hardware abstraction methods and devices.

30 Claims, 17 Drawing Sheets

(56) References Cited

U.S. PATENT DOCUMENTS

| | | | | |
|---|---|---|---|---|
| 2003/0188306 | A1* | 10/2003 | Harris et al. | 717/174 |
| 2003/0200290 | A1* | 10/2003 | Zimmerman et al. | 709/222 |
| 2003/0212859 | A1 | 11/2003 | Ellis et al. | |
| 2004/0043814 | A1 | 3/2004 | Angell et al. | |
| 2004/0147314 | A1* | 7/2004 | LeMay et al. | 463/30 |
| 2004/0214628 | A1 | 10/2004 | Boyd et al. | |
| 2005/0223219 | A1* | 10/2005 | Gatto et al. | 713/156 |
| 2005/0235117 | A1 | 10/2005 | Floman et al. | |
| 2005/0239538 | A1* | 10/2005 | Dixon | 463/20 |
| 2005/0261062 | A1* | 11/2005 | Lewin et al. | 463/42 |
| 2006/0046819 | A1 | 3/2006 | Nguyen et al. | |
| 2006/0046824 | A1 | 3/2006 | Silva et al. | |
| 2006/0046855 | A1 | 3/2006 | Nguyen et al. | |

FOREIGN PATENT DOCUMENTS

| | | |
|---|---|---|
| EP | 1934959 | 6/2008 |
| WO | 99/60498 | 11/1999 |
| WO | 2007/021506 | 2/2007 |

OTHER PUBLICATIONS

U.S. Office Action mailed Oct. 4, 2007, from U.S. Appl. No. 10/927,581.
International Search Report, mailed Nov. 24, 2006 from related International Application No. PCT/US2006/029549, 6 pp. including Notification of Transmittal.
Written Opinion of the International Searching Authority, mailed Nov. 24, 2006 from related International Application No. PCT/US2006/029549, 5 pp.
US Final Office Action dated Mar. 31, 2008 issued in U.S. Appl. No. 10/927,581.
US Office Action dated Oct. 3, 2008 issued in U.S. Appl. No. 10/927,581.
US Final Office Action dated Apr. 6, 2009 issued in U.S. Appl. No. 10/927,581.
US Office Action dated Sep. 21, 2009 issued in U.S. Appl. No. 11/225,406.
Chinese Office Action dated Aug. 21, 2009 issued in 200680028848.9.
US Office Action dated Oct. 6, 2009 issued in U.S. Appl. No. 10/927,581.
US Interview Summary dated Jan. 13, 2010 issued in U.S. Appl. No. 10/927,581.
US Office Action dated Apr. 8, 2010 issued in U.S. Appl. No. 10/927,581.
US Final Office Action dated Apr. 7, 2010 issued in U.S. Appl. No. 11/225,406.
Chinese Office Action dated May 17, 2010 issued in 200680028848.9.
Australian Office Action dated Apr. 1, 2010 issued in 2005204245.
U.S. Interview Summary dated Jun. 30, 2010, from U.S. Appl. No. 10/927,581.
U.S. Final Office Action dated Dec. 10, 2010, from U.S. Appl. No. 10/927,581.
U.S. Notice of Panel Decision from Pre-Appeal Brief Review dated Apr. 27, 2011, from U.S. Appl. No. 10/927,581.
Australian Examination Report dated Nov. 17, 2010, from Application No. 2006280249.
Australian Examination Report dated Nov. 9, 2011, from Application No. 2006280249.
Chinese Office Action dated Apr. 6, 2011, from Application No. 200680028848.9.
Chinese Office Action dated Jun. 23, 2011, from Application No. 200680028848.9.
International Preliminary Report on Patentability dated Feb. 20, 2008, from Application No. PCT/US2006/029549.
U.S. Notice of Allowance dated Jan. 15, 2013, from U.S. Appl. No. 10/927,581.
US Office Action dated Mar. 15, 2013 issued in U.S. Appl. No. 11/225,406.
Australian Third Examination Report dated Dec. 14, 2011 issued in AU2006280249.
U.S. Office Action dated Mar. 16, 2012 issued in U.S. Appl. No. 10/927,581.

* cited by examiner

SOFTWARE DOWNLOAD CARD

EMULATION METHODS AND DEVICES FOR A GAMING MACHINE

CROSS-REFERENCE TO RELATED APPLICATIONS

This application is related to U.S. patent application Ser. No. 10/927,581, entitled "Module for a Gaming Machine" and filed Aug. 25, 2004, which is hereby incorporated by reference for all purposes.

BACKGROUND OF THE INVENTION

This invention relates to game playing methods for gaming machines such as video slot machines, video poker machines, bingo machines, etc. More particularly, the present invention relates to methods and apparatus for providing additional capabilities, e.g., downloading and gaming capabilities, to a gaming machine.

There are a wide variety of associated devices that can be connected to a gaming machine such as a slot machine or video poker machine. Some examples of these devices are player tracking units, lights, ticket printers, card readers, speakers, bill validators, ticket readers, coin acceptors, display panels, key pads, coin hoppers and button pads. Many of these devices are built into the gaming machine or components associated with the gaming machine, such as a top box that usually sits on top of the gaming machine.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including touch screens and button pads, to determine the wager amount and initiate game play.

After game play has been initiated, the gaming machine determines a game outcome, presents the game outcome to the player and may dispense an award of some type depending on the outcome of the game. A game outcome presentation may utilize many different visual and audio components such as flashing lights, music, sounds and graphics. The visual and audio components of the game outcome presentation may be used to draw a player's attention to various game features and to heighten the player's interest in additional game play. Maintaining a game player's interest in game play, such as on a gaming machine or during other gaming activities, is an important consideration for an operator of a gaming establishment.

One method of maintaining a player's interest in game play is to provide new data, such as new or updated games, new content, etc., for gaming machines. As used herein, the term "data" will encompass software and content. In addition, it may be desirable to download data (e.g., new or updated software) for an associated device, such as a player tracking system and/or for a peripheral device. However, many installed gaming machines are not configured for downloading data from a network. In some instances, the gaming machine itself may not be configured for networking with a game server. In other instances, a gaming establishment may choose not to configure its gaming machines for communication with such network devices, e.g., because the gaming establishment does not have enough gaming machines to justify the cost of such a network.

Players' interest may also be enhanced by enhanced audio and/or visual displays that are possible with new peripheral devices. For example, players will generally prefer a liquid crystal ("LCD") display over the prior art cathode ray tube ("CRT") displays of many legacy gaming machines. In addition, players may appreciate the audio and visual effects made possible by the faster processing speeds of modern processors.

Although players will generally enjoy the benefits of gaming machine upgrades, players still may wish to play at least some familiar, existing games of chance on newer gaming machines. For example, a player may have one or more favorite games, perhaps associated with an enjoyable gaming experience of the past.

However, gaming software is quite platform-specific. A considerable amount of effort is required to re-write legacy gaming software so that such existing games can be provided on gaming machines having an upgraded CPU and/or different peripheral devices. One option is to take the old source code and re-compile it for native software on the new gaming machine platform. Alternatively, the source code may be re-written from scratch. It would be desirable to provide devices and methods for overcoming at least some of the foregoing drawbacks.

SUMMARY OF THE INVENTION

The invention provides numerous methods and devices for enhancing the functionality of gaming machines. Some embodiments of the invention provide enhanced functionality for legacy gaming machines. Alternative embodiments of the invention may be implemented in an entirely new gaming machine and/or in gaming machines that are not yet in existence. Some such implementations are directed to the use of legacy gaming software or other non-native gaming software in gaming machines that include (a) different peripheral devices and/or (b) a different CPU from that of the gaming machine for which the gaming software was written. These implementations may use software emulation and hardware abstraction methods and devices.

Some embodiments of the invention provide a gaming machine comprising the following elements: a plurality of first peripheral devices for receiving cash or indicia of credit for wagers on games of chance, for presenting the games of chance and for outputting cash or indicia of credit; a first processor for executing first game software instructions for providing games of chance by controlling the peripheral devices; a software emulator for translating second game software instructions written for a second processor to first game software instructions executable by the first processor; and a hardware abstraction layer ("HAL") configured to emulate second peripheral devices of a second gaming machine for which the second software instructions were written. The gaming machine may be operable in an emulation mode wherein the gaming machine can execute second game software instructions and also operable in a native mode wherein at least the software emulator is disabled.

The gaming machine preferably includes means for determining when the software emulator should be enabled or disabled. For example, a logic device may determine when the software emulator should be enabled or disabled based upon information (such as a header or a flag) in selected game software and/or upon capabilities of the gaming machine. The determining means may also determine whether the hardware abstraction layer should be enabled when the gaming machine is running in native mode. The logic device may determine when the software emulator should be enabled or disabled based upon whether selected game software is native game software executable by the first processor. The gaming machine may include means for downloading the selected game software and/or for downloading emulation software.

At least one of the first peripheral devices of the gaming machine may be different from a corresponding second peripheral device of the second gaming machine. In some embodiments, at least one of the first peripheral devices of the gaming machine has no counterpart second peripheral device of the second gaming machine.

The HAL may comprise a programmable logic device and/or software embodied in a machine-readable medium. The HAL may be configurable to present a new peripheral device as a second peripheral device.

Alternative implementations of the invention provide a gaming module, comprising: a port configured for communication with a network; an interface configured for communication with a gaming machine; and a first CPU. The first CPU is configured for downloading games of chance from a game server via the first port, for executing the downloaded games of chance and for communicating with peripheral devices of a gaming machine via the interface and via a second CPU of the gaming machine.

The gaming module may include an emulator for translating second game software instructions written for the second CPU to first game software instructions executable by the first CPU. The gaming module may be operable in an emulation mode wherein the emulator is enabled and also operable in a native mode wherein the emulator is disabled. The gaming module may also include a hardware abstraction layer.

The first CPU may be further configured for enabling player tracking functionality. The first CPU may be further configured to control the second CPU to operate in a first game-executing mode or a second mode wherein the first CPU controls game execution. The first CPU may control the second CPU to operate in the first game-executing mode when the first CPU determines that a desired game of chance was written to be executed by the second CPU. A first core of a multi-core processor may comprise the first CPU and a second core of the multi-core processor may comprise the second CPU.

A logic device may determine when the emulator should be enabled or disabled based upon information (such as a header or a flag) in selected game software and/or upon capabilities of the first CPU. The logic device may determine when the emulator should be enabled or disabled based upon whether selected game software is native game software executable by the first CPU.

Alternative implementations of the invention provide a gaming system, comprising a gaming module and a gaming machine. The gaming module includes these elements: a first port; a first CPU configured for downloading games of chance from a game server via the first port and for executing the downloaded games of chance; and a first random access memory ("RAM") configured for communication with the first CPU, the first RAM being configured to store downloaded games of chance from the first CPU. The gaming machine includes these elements: a plurality of peripheral devices for receiving cash or indicia of credit for wagers on games of chance, for presenting the games of chance and for outputting cash or indicia of credit; and a second CPU in communication with the plurality of peripheral devices, wherein the first CPU is configured for communicating with at least some of the plurality of peripheral devices via the second CPU. The gaming system may include a multi-core processor, wherein a first core of the multi-core processor comprises the first CPU and a second core of the multi-core processor comprises the second CPU.

Alternative implementations of the invention provide a gaming method that includes these steps: receiving an indication that a player desires to play a selected game of chance on a gaming machine; determining whether gaming software for the selected game of chance was written for the gaming machine; and executing the gaming software according to the determination of the determining step.

When it is determined in the determining step that the gaming software was not written for the gaming machine, the method may include the step of emulating the gaming machine for which the gaming software was written. The method may involve determining that the required emulation software is not available locally and downloading the required emulation software.

The method may include the step of downloading the gaming software. The method may include the steps of determining that a feature of the gaming software is not allowed within a jurisdiction of the player; and disabling the feature. The method may include the steps of determining a protocol necessary to communication with a game server; and downloading the gaming software from the game server according to the protocol.

The methods of the present invention may be implemented in software, hardware or firmware. Some such methods may be implemented in gaming machines or portions thereof, such as CPU boards of gaming machines, logic devices (including but not limited to programmable logic devices such as field programmable gate arrays ["FPGAs"]) or modules that are configured for communication with gaming machines. Other methods may be implemented by associated network devices or portions thereof, such as game servers and other servers that provide information or functionality regarding game software downloads.

These and other features and advantages of the invention will be described in more detail below with reference to the associated drawings.

DESCRIPTION OF THE PREFERRED EMBODIMENTS

Although the present invention may be manifested in a variety of ways, some implementations of the present invention provide a module for providing enhanced functionality for existing gaming machines. In some embodiments, few (or no) modifications are made to the main gaming machine itself, so that the module may simply be added to an existing gaming machine. The module may be configured to receive data from a portable memory device and/or from a network device, e.g., from a game server, a content server, etc.

However, other implementations of the invention involve substantial modifications to a legacy gaming machine, e.g., the addition of a new CPU board. Still other implementations of the invention may be implemented in an entirely new gaming machine and/or in gaming machines that are not yet in existence. Some such implementations are directed to the use of legacy gaming software in gaming machines that include (a) different peripheral devices and/or (b) a different CPU from that of the gaming machine for which the gaming software was written.

In some embodiments, a novel module includes, or is disposed within, a player tracking unit. U.S. patent application Ser. Nos. 10/246,373 and 10/241,398, respectively entitled "Player Tracking Communication Mechanisms In A Gaming Machine" and "Method and Apparatus for Managing Gaming Machine Code Downloads," are hereby incorporated by reference. Application Ser. Nos. 10/246,373 and 10/241,398 describe, inter alia, some player tracking units that may be modified to perform some of the method of the present invention.

Figure 1:
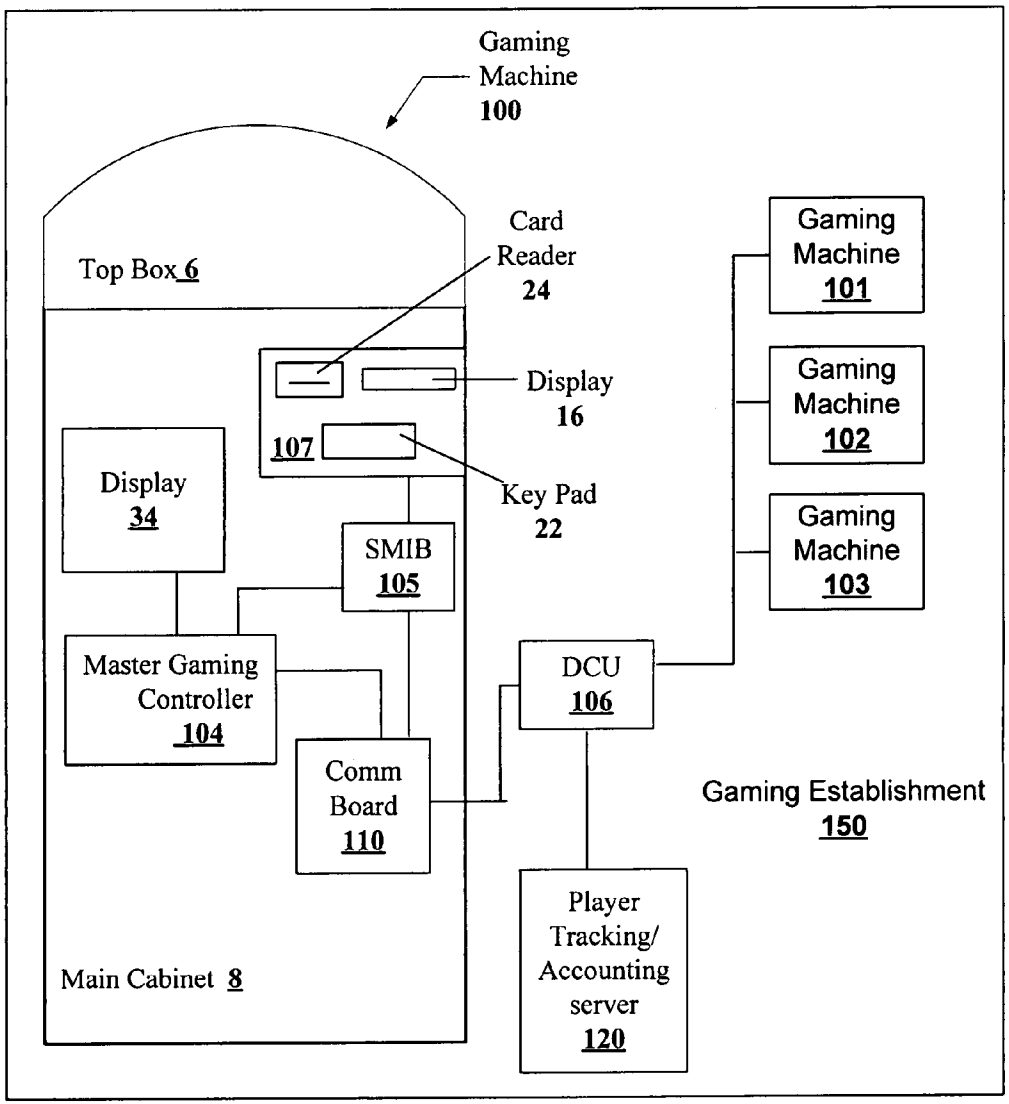
FIG. 1 is a block diagram of a number of gaming machines with player tracking units connected to servers providing player tracking services.

FIG. 1 is a block diagram of an illustrative conventional player tracking system. Although the player tracking system shown in FIG. 1 is described as "conventional" herein, it may be the basis for novel player tracking systems, including those provided by the present invention. FIG. 1 illustrates a number of gaming machines with player tracking units connected to servers providing player tracking services. In gaming establishment 150, gaming machines 100, 101, 102 and 103 are connected, via the data collection unit (DCU) 106 to the player tracking/accounting server 120. The DCU 106, which may be connected to up to 32 player tracking units as part of a local network in a particular example, consolidates the information gathered from player tracking units in gaming machines 100, 101, 102 and 103 and forwards the information to the player tracking account server 120. The player tracking account server is designed 1) to store player tracking account information, such as information regarding a player's previous game play, and 2) to calculate player tracking points based on a player's game play that may be used as basis for providing rewards to the player.

In gaming machine 100 of gaming establishment 150, a player tracking unit 107 and slot machine interface board (SMIB) 105 are mounted within a main cabinet 8 of the gaming machine. A top box 6 is mounted on top of the main cabinet 8 of the gaining machine. In many types of gaming machines, the player tracking unit is mounted within the top box 6. Usually, player tracking units, such as 107, and SMIBs, such as 105, are manufactured as separate modules before installation into a gaming machine, such as 100. Accordingly, some embodiments of the present invention are combined with a preexisting module, such as a player tracking unit, for easy integration with existing gaming machines. Such embodiments include specialized features for performing the types of enhancements that they provide to the gaming machine. These features will be described in detail below.

The player tracking unit 107 includes three player tracking devices, a card reader 24, a key pad 22, and a display 16, all mounted within the unit. The player tracking devices are used to input player tracking information that is needed to implement the player tracking program. The player tracking devices may be mounted in many different arrangements depending upon design constraints such as accessibility to the player, packaging constraints of a gaming machine and a configuration of a gaming machine. For instance, the player tracking devices may be mounted flush with a vertical surface in an upright gaming machine and may be mounted flush or at a slight angle upward with a horizontal in a flat top gaming machine.

The player tracking unit 107 communicates with the player tracking server via the SMIB 105, a main communication board 110 and the data collection unit 106. The SMIB 105 allows the player tracking unit 107 to gather information from the gaming machine 100 such as an amount a player has wagered during a game play session. This information may be used by the player tracking server 120 to calculate player tracking points for the player. In the example shown in FIG. 1, the player tracking unit 107 is connected to the master gaming controller 104 via a serial connection using a wire serial connector and communicates with the master gaming controller 104 using a serial communication protocol. However, as described below (e.g., with reference to FIG. 3A), some preferred implementations of the invention communicate with the gaming machine across a parallel bus. Some implementations include both a serial bus and a parallel bus.

The serial connection between the SMIB 105 and the master gaming controller 104 may be through the main communication board 110, through another intermediate device or through a direct connection to the master gaming controller 104. In general, communication between the various gaming devices is provided using wire connectors with proprietary communication protocols. As an example of a proprietary serial communication protocol, the master gaming controller 104 may employ a subset of the Slot Accounting System (SAS protocol) developed by International Game Technology of Reno, Nev. to communicate with the player tracking unit 107.

In this example, when a game player wants to play a game on a gaming machine and utilize the player tracking services available through the player tracking unit, a game player inserts a player tracking card, such as a magnetic striped card, into the card reader 24. Co-pending U.S. patent application Ser. No. 10/214,936, filed Aug. 6, 2002 and entitled "Flexible Loyalty Points Programs," is hereby incorporated by reference for all purposes. As described in application Ser. No. 10/214,936, various other types of player tracking cards, devices and readers may be used. Here, after the magnetic striped card has been so inserted, the player tracking unit 107 may detect this event and receive certain identification information contained on the card. For example, a player's name, address, and player tracking account number encoded on the magnetic striped card, may be received by the player tracking unit 107. In general, a player must provide identification information of some type to utilize player tracking services available on a gaming machine. For current player tracking programs, the most common approach for providing identification information is to issue a magnetic-striped card storing the necessary identification information to each player that wishes to participate in a given player tracking program.

After a player has inserted her or his player tracking card into the card reader 24, the player tracking unit 107 may command the display 16 to display the game player's name on the display 16 and also, may optionally display a message requesting the game player to validate their identity by entering an identification code using the key pad 22. Once the game player's identity has been validated, the player tracking information is relayed to the player tracking server 120. Typically, the player tracking server 120 stores player tracking account records including the number of player tracking points previously accumulated by the player.

During game play on the gaming machine, the player tracking unit 107 may poll the master gaming controller 104 for game play information such as how much money the player has wagered on each game, the time when each game was initiated and the location of the gaming machine. The game play information is sent by the player tracking unit 107 to the player tracking server 120. While a player tracking card is inserted in the card reader 24, the player tracking server 120 may use the game play information provided by the player tracking unit 107 to generate player tracking points and add the points to a player tracking account identified by the player tracking card. The player tracking points generated by the player tracking server 120 are stored in a memory of some type on the player tracking server.

Some embodiments of the invention allow data to be downloaded from a portable memory device to a module such as a player tracking device. The data may include software or content, such as advertisements, video clips, etc. In some such embodiments, the data are downloaded from a "smart card" or similar card, using a card reader of a player tracking unit. U.S. patent application Ser. No. 09/718,974, entitled "EZ Pay Smart Card and Ticket System," which describes relevant methods and devices for downloading software from smart cards, is hereby incorporated by reference.

In other embodiments, the data are downloaded from a memory stick into a port of the module, such as a USB port. U.S. Pat. No. 6,439,996, entitled "Key for a Gaming Machine and Method of Use Thereof," which describes relevant methods and devices for downloading information from a portable memory device to a communication port of a gaming machine, is hereby incorporated by reference. Modules suitable for downloading will be described below with reference to FIGS. 2A and 2B.

Figure 2A:
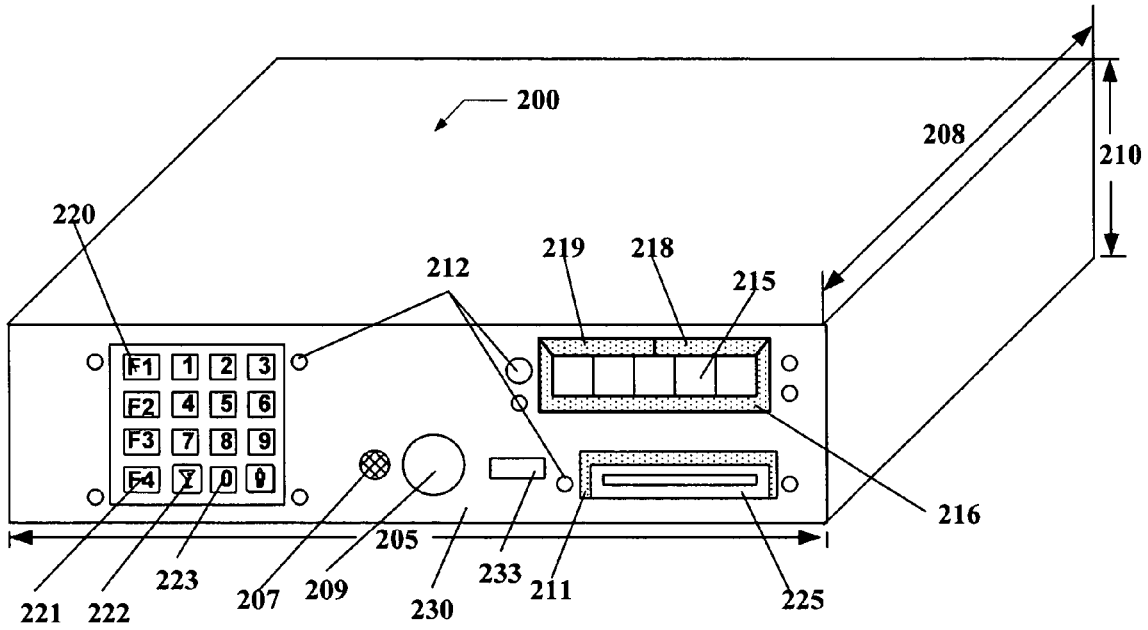
FIGS. 2A and 2B are perspective diagrams of two embodiments of modules according to the present invention.
Figure 2B:
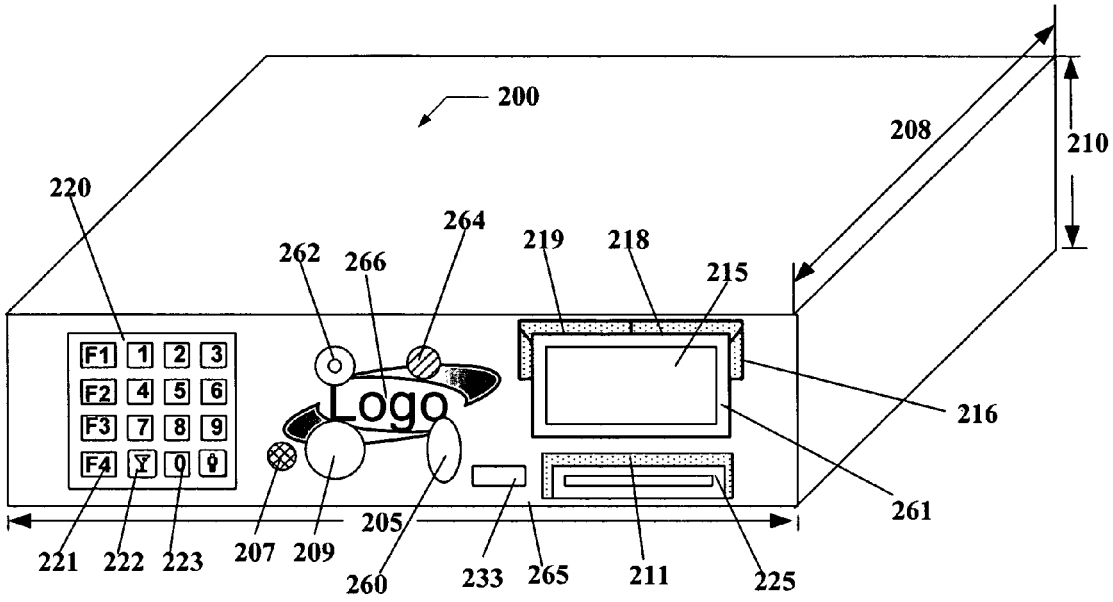

FIGS. 2A and 2B are perspective diagrams of different embodiments of modules of the present invention. In these examples, the modules also provide the functionality of player tracking units. Details of FIGS. 2A 2B not described herein are set forth with reference to FIGS. 2A and 2C of U.S. patent application Ser. No. 10/246,373, entitled "Player Tracking Communication Mechanisms In A Gaming Machine," which has been incorporated herein by reference for all purposes.

FIG. 2A is a front diagram for a housing or chassis 200 enclosing a number of interface peripherals. The interface peripherals may be used to provide input and output (I/O) to one or more network devices, to various types of portable storage devices, or to other gaming systems such as a gaming machine. The device housing 200 may enclose a logic device (not shown) and other electronics configured to execute the methods of the present invention or the logic device may be enclosed in a logic device housing separate from the device housing 200.

Using the interface devices enclosed in the housing 200, data may be downloaded and information, such as gaming and player tracking information, may be input to the module. Information may be visually and aurally communicated to various individuals that may use the module, such as game players, casino service representatives and maintenance technicians. Illumination devices, such as back lit key pad buttons (e.g. 221, 222 and 223), light 211 and light 216 and sound projection devices, such as speaker 209, can visually and/or aurally communicate game information, display content, etc. The function buttons, F1, F2, F3 and F4 (i.e. 221) may be used to provide various services through the module.

The device housing 200 encloses a display 215, a key pad 220, a microphone 207, a speaker 209, a card reader 225, a light 216 adjacent to the card reader 225 and a light 216 adjacent to the display 215. The modules shown in FIGS. 2A and 2B include card readers 225 that can read data from a portable storage device such as a "smart card." Moreover, the modules shown in FIGS. 2A and 2B include ports 233 for downloading data from other types of portable storage devices, such as memory sticks. These ports may be accessible, as shown, but are preferably located in a protected area, e.g., in a locked box.

The dimensions of the device housing 200, (e.g. 205, 208 and 210) are shown in FIGS. 2A and 2B. The device housing 200 is shown as a rectangular box for illustrative purposes only. A shape of the device housing 200 is variable and is not strictly limited to rectangular shapes. Further, dimensions of the cut-outs on the face plate 230 for the player tracking interface devices may vary depending the manufacturer of a particular interface peripheral device which may be used in a player tracking device.

FIG. 2B is a front diagram for a housing or chassis 200 enclosing a number of interface peripherals according to another embodiment of the present invention. The front plate 230 is covered with a decorative skin 265 with a silk-screen logo 266.

In addition to the player tracking interface devices described with respect to FIG. 2A, the player tracking housing 200 includes a wireless interface 264, a camera 262 and a finger-print reader with platen 260. A description of a finger print reader as an identification device is provided in co-pending U.S. application Ser. No. 09/172,787, filed Oct. 14, 1998, by Wells, et al., entitled "Gaming Device Identification method and Apparatus," which is incorporated herein in its entirety and for all purposes.

In this example, display 215 is a color LCD. Other display technologies (such as organic electro-luminescent devices) may be used with the display 215. Display 215 and speaker 209 may be used for any convenient purpose, e.g., to reproduce downloaded content such as video clips or advertisements, to communicate game information, to display information regarding the status of a data download, of software installation, etc. For instance, when a portable memory device such as a card has been inserted incorrectly in the card reader 225, a message (e.g., "card not inserted correctly") may be projected from the speaker. Many different types of information may be visually or aurally communicated using the present invention and such information is not limited to the examples provided above.

User preferences, such as the language preferred by the person using the machine may be stored on a portable memory device. According to some implementations, such information may be stored on a smart card, memory stick, player tracking card, etc. Alternatively, a user of the module may be able to specify a language using one of the input devices on the module. For example, such preferences may be based on a user profile previously established by the person using the module.

Figure 3A:
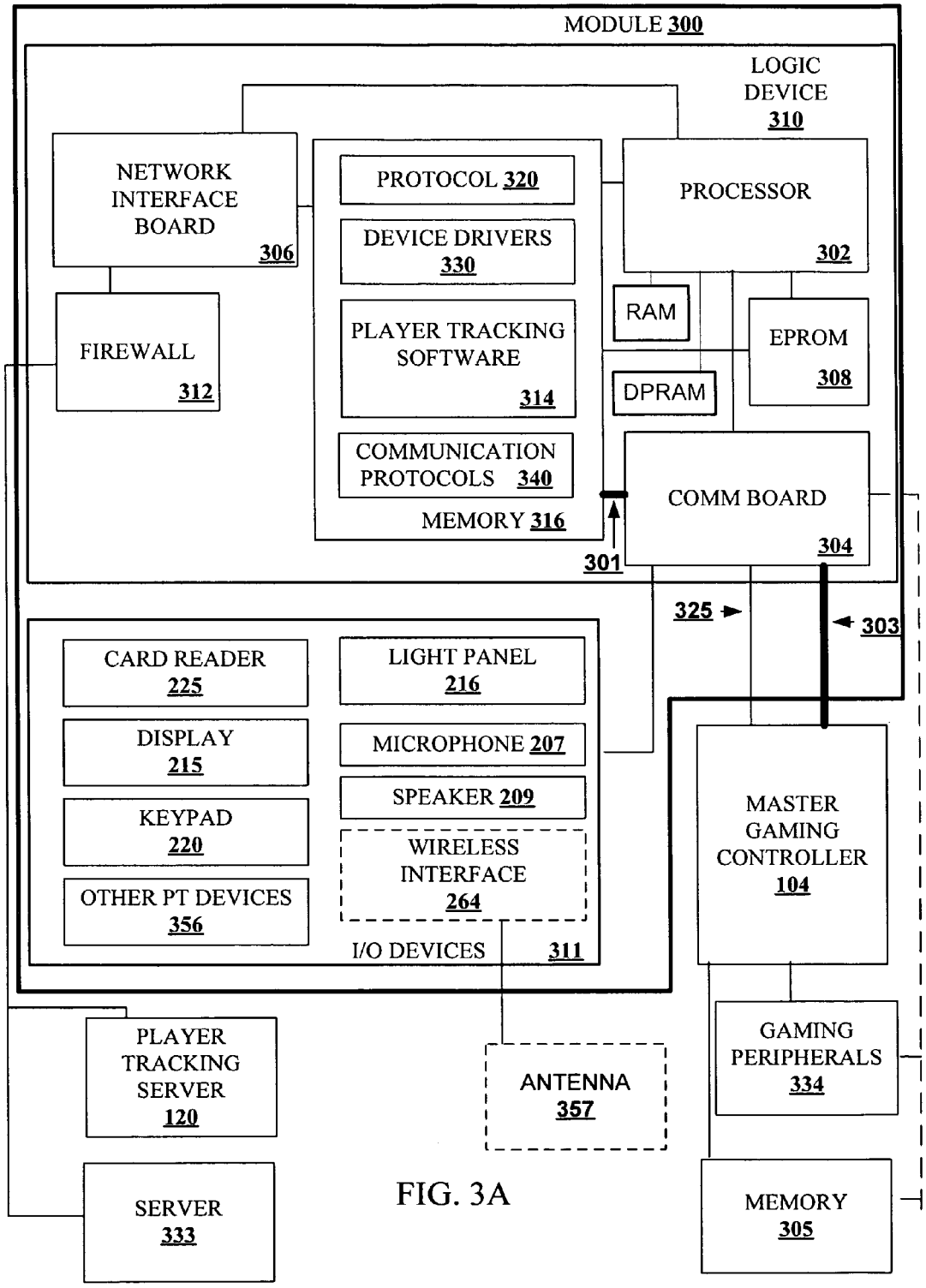
FIG. 3A is a block diagram of the components of a module according to some embodiments of the present invention.

FIG. 3A is a block diagram of an embodiment of a module 300 of the present invention connected to a gaming machine and two exemplary network devices. The module 300 includes a logic device 310 enclosed in a logic device housing and a number of interface devices including a card reader 225, a display 215, a key pad 220, a light panel 216, a microphone 207, a speaker 209, a wireless interface and other interface devices 356 enclosed in a device housing 311. The logic device 310 for the module and the interface devices may be enclosed in a single housing (see FIGS. 2A and 2B) or in separate housings.

The logic device 310 may include one or more processors for executing software allowing the module 300 to perform various functions such as communicating with servers 120 and 333 and one or more components of a gaming machine. In this example, module 300 is networked for communication with player tracking server 120 and game server 333. In other implementations, a module may be configured for communication with other network devices, such as servers for downloading content such as audio, video, advertisements, etc. Alternatively, a module could be configured for communication with a messaging server, a cashless system server, or other network devices. As noted above, it is desirable to provide a module that requires few or no modifications of the gaming machine.

Module 300 preferably performs data authentication and verification functions for downloaded data. In some embodiments, the verification may be performed by processor 302. Alternatively, the gaming machine (e.g., master gaming controller 104 could authenticate and verify downloaded data. The former option is preferable, so that the gaming machine does not need to be reconfigured for authentication and verification purposes.

In this example, logic device 310 allows module 300 to communicate with master gaming controller 104 and to operate various peripheral devices, such as card reader 225, display 215, key pad 220 and light panel 216. For instance, the logic device 310 may send messages containing player tracking information to the display 215. As another example, the logic device 310 may send commands to the light panel 216 to display a particular light pattern and to the speaker 209 to project a sound to visually and aurally convey game information. The logic device 310 may utilize a microprocessor and/or microcontrollers. For instance, the light panel 216 may include a microcontroller that converts signals from the processor 302 to voltage levels for one or more illumination devices. U.S. Pat. No. 6,368,216, entitled "Gaming Machine Having Secondary Display for Providing Video Content," is hereby incorporated by reference.

In one embodiment, application software for module 300 and configuration information for the player tracking unit may be stored in a memory device such as an EPROM 308, a non-volatile memory, hard drive or a flash memory. Here, module 300 also includes memory 316. In this example, memory 316 is configured to store: 1) player tracking software 314 such as data collection software, 2) communication protocols (e.g. 320) allowing module 300 to communicate with different types of network devices, 3) device drivers for many types of interface devices (e.g. 330), 4) voice recognition software for receiving voice commands from the microphone 207, 5) a secondary memory storage device such as a non-volatile memory device, configured to store gaming software related information (the gaming software related information and memory may be used in a game download process or other software download process), and 6) communication transport protocols (e.g. 340) such as TCP/IP, USB, IEEE1394, Bluetooth, IEEE 802.11a, IEEE 802.11b, IEEE 802.11x (e.g. other IEEE 802.11 standards), hiperlan/2, and HomeRF allowing module 300 to communicate with devices using these protocols or communication protocols allowing the logic device to communicate with different types of master gaming controllers (e.g. master gaming controllers using different types of communication protocols), such as 104.

In the embodiment shown in FIG. 3A, module 300 communicates with the gaming machine using 2 different interfaces. Interface 325 is a relatively low speed serial bus that is suitable for, e.g., communicating player tracking information. Accordingly, the master gaming controller, such as 104, communicates over bus 325 using a serial communication protocol. A few examples of serial communication protocols that may be used to communicate with the master gaming controller include but are not limited to USB, RS-232 and Netplex (a proprietary protocol developed by IGT, Reno, Nev.). Interface 325 is primarily used to bridge to legacy machines.

Interface 303 is a high speed bus that is suitable for rapidly transferring data between module 300 and the gaming machine. The bus may be any convenient width, for example, a 32-bit width. In that case, there would be 32 I/O lines.

In the example shown, interface 301 is also a high-speed interface. This configuration allows data downloaded from a network device or a portable memory device to be stored in memory 316 temporarily, then downloaded to master gaming controller 104 via the dual ported random access memory ("DPRAM") interface either immediately, or at some later time. Data can be simultaneously read from and written to a DPRAM module. Therefore, in implementations that include a DPRAM module, e.g., in logic device 310 or on the Communication Board 304, downloaded data can be simultaneously written to the DPRAM module from a processor (e.g. processor 302 or a processor of network interface board 306) and written to the gaming machine (here, to master gaming controller 104). Master gaming controller 104 can store the data in a memory device of the gaming machine.

Depending on the embodiment of module 300, logic device 310 may enable module 300 to bypass master gaming controller 104 and communicate directly with other components of a gaming machine. These components may include memory 305 and/or gaming peripherals 334. For example, in some embodiments of the invention, this direct communication allows a memory of module 300 to emulate memory 305 of the gaming machine. Memory 305 may be, for example, a random access memory such as an EPROM that contains gaming software that is intended to be executed by master gaming controller 104. As used herein, a "random access memory" includes both read-only memory ("ROM") and read/write memory such as DRAM and SRAM. A connection such as a jumper (e.g., an EPROM emulator) could connect module 300 to memory 305, e.g., to an EPROM socket. Such a connection should be pin-to-pin compatible with memory 305. When the master gaming controller 104 seeks to execute a program stored in memory 305, the game codes are actually coming from module 300 (e.g., previous downloaded to the EPROM emulator from memory 316). This configuration allows master gaming controller 104 to execute software directly from module 300. Such a configuration is particularly advantageous because it eliminates the need for, e.g., replacing an EPROM of the gaming machine or reconfiguring a CPU of a legacy machine to process and store downloaded data.

In alternative embodiments of the invention, a processor of module 300 is configured to perform gaming machine functions. For example, processor 302 may execute gaming software that has been downloaded and stored in a memory of module 300 (e.g., in memory 316), thereby bypassing (at least in part) the functionality of master gaming controller 104. Alternatively, one or more processors are dedicated to gaming and one or more other processors perform the other functions of module 300 (e.g., player tracking functions). In implementations wherein module 300 is executing gaming software, module 300 preferably controls at least some of gaming peripherals 334 for implementation of a game (e.g., a game of chance).

Some preferred embodiments of module 300 (e.g., wherein one or more processors of module 300 are configured to perform gaming machine functions) are implemented with special features and/or additional circuitry that differentiates gaming machines of the present assignee from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset since the operating system is presumably crashed or other malfunctions occurred. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA 232 serial interfaces provided by general-purpose computers. These interfaces may include EIA 485, EIA 422, Fiber Optic Serial, Optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel. Interfaces to external devices are typically optically coupled (isolated) to prevent possible ESD damages to internal circuitry, or unexpected failure with $3^{rd}$-party peripherals. Optical isolation also provides added security against unauthorized data sniffing devices.

IGT Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

A plurality of device drivers may be stored in memory 316 for each type of player tracking device. For example, device drivers for five different types of card readers, six different types of displays, seven different types of portable memory modules and eight different types of key pads may be stored in the memory 316. When one type of a particular peripheral device is exchanged for another type of the particular device, a new device driver may be loaded from the memory 316 by the processor 302 to allow communication with the device. For instance, one type of card reader in module 300 may be replaced with a second type of card reader where device drivers for both card readers are stored in the memory 316.

In some embodiments, the software units stored in the memory 316 may be upgraded as needed. For instance, new device drivers or new communication protocols may be downloaded to memory 316 from a network device, a portable memory device such as a smart card or a memory stick, or from some other external device. In some implementations, data such as software and content may be downloaded as described in U.S. patent application Ser. No. 11/078,966, "Secured Virtual Network in a Gaming Environment, U.S. patent application Ser. No. 10/241,398, "Method and Apparatus for Managing Gaming Machine Code Downloads," U.S. patent application Ser. No. 10/757,609, "Method and Apparatus for Gaming Machine Data Downloading" and/or U.S. patent application Ser. No. 10/926,636, "Methods and Devices for Gaming Account Management," each of which is incorporated by reference in its entirety.

As another example, when the memory 316 is a CD/DVD drive containing a CD/DVD designed or configured to store the player tracking software 314, the device drivers and other communication protocols, the software stored in the memory may be upgraded by replacing a first CD/DVD with a second CD/DVD. In yet another example, when the memory 316 uses one or more flash memory units designed or configured to store the player tracking software 314, the device drivers and other communication protocols, the software stored in the flash memory units may be upgraded by replacing one or more flash memory units with new flash memory units storing the upgraded software.

In one embodiment of the present invention, a minimal set of player tracking software applications 314, communication protocols 340, communication protocols and device drivers may be stored on in the memory 316. For instance, an operating system, a communication protocol allowing module 300 to communicate with a remote server such as the player tracking server 120 and one or more common player tracking applications may be stored in memory 316. When the player tracking unit is powered-up, module 300 may contact a remote server 120 and download specific player tracking software from the remote software. The downloaded software may include, but is not limited to one or more particular applications that are supported by the remote server, particular device drivers, software upgrades and particular communication protocols supported by the remote servers. Details of methods for downloading player tracking software are described in co-pending U.S. application Ser. No. 09/838,033, filed on Mar. 19, 2001, by Criss-Puskiewicz, et al., entitled, "UNIVERSAL PLAYER TRACKING SYSTEM," which application is incorporated herein in its entirety and all for purposes.

The logic device 310 includes a network interface board 306 configured or designed to allow communication between module 300 and other remote devices such as server 120, 333, etc. These servers may reside on local area networks, such as a casino area network, a personal area network such as a piconet (e.g. using Bluetooth), or a wide area network such as the Internet. The network interface board 306 may allow wireless or wired communication with the remote devices.

The network interface board may be connected to a firewall 312. The firewall may be hardware, software or combinations of both that prevent illegal access of the gaming machine by an outside entity connected to the gaming machine. The internal firewall is designed to prevent someone such as a hacker from gaining illegal access to a module 300 or a gaming machine and tampering with it in some manner. For instance, an illegal access may be an attempt to plant a program in module 300 that alters the operation of the gaming machine allowing it to perform an unintended function.

The communication board 304 may be configured to allow communication between the logic device 310 and interface devices including 225, 215, 220, 216, 207, 209 and 356 and to allow communication between the logic device 310 and the gaming machine (e.g., with master gaming controller 104, memory 305 and/or gaming peripherals 334.

Optional wireless interface 264 may be used to allow module 300 and possibly the gaming machine to communicate with portable wireless devices or stationary devices using a wireless communication standard. The wireless interface 264 may be connected to an antenna 357. In some embodiments, the wireless interface 264 may be incorporated into the communication board 304. In addition, in some embodiments, the logic device 310 and the master gaming controller 104 may communicate using a non-proprietary standard wireless communication protocol such as Bluetooth, IEEE 802.11a, IEE802.11b, IEEE802.11x (e.g. other IEEE802.11 standards), hiperlan/2, and HomeRF or using a non-proprietary standard wired communication protocol such as USB, Firewire, IEEE 1394 and the like. In the past, gaming machines have primarily used proprietary standards for communications between gaming devices. In other embodiments, the logic device 310 and the gaming machine may communicate using a proprietary communication protocol used by the manufacturer of the gaming machine. The communication between module 300 and any other external or internal devices may be encrypted.

In one embodiment, the logic device 310 may poll interface devices for information. For instance, the logic device 310 may poll the card reader 225 to determine when a card has been inserted into the card reader or may poll the key pad 220 to determine when a button key has been depressed. In some embodiments, the interface devices may contact the logic device 310 when an event has occurred, such as a card being inserted into the card reader.

The logic device 310 may poll one or more processors that control gaming (e.g., master gaming controller 104) for game usage information. For instance, the logic device 310 may send a message to the master gaming controller 104 such as "coin in." The master gaming controller may respond to the "coin in" message with an amount when credits are registered on the gaming machine.

The logic device 310, using an appropriate device driver, may send instructions to the various interface devices to perform specific operations. For instance, after a card has been inserted into the card reader 225, the processor logic device may send a "read card" instruction to the card reader and a "display message A" instruction to the display 215. In addition, the logic device 310 may be configured to send instructions, or to allow the master gaming controller 104 to send instructions, to the interface devices via the logic device 310. As an example, after a card has been inserted into the card reader 225, the processor logic 310 may determine that the card is for a gaming application controlled by the master gaming controller 204 and send a message to the master gaming controller 104 indicating a card has been inserted into the card reader. In response, to the message from the logic device, the master gaming controller 104 may send a series of commands to the player tracking interface devices such as a "read card" instruction to the card reader 225, a flash light pattern "A" command to the light panel 216, and a "display message" instruction to the display 215 via the logic device 310. The instructions from the master gaming controller 104 to the player tracking interface devices may be obtained from gaming application software executed by the master gaming controller 104. The gaming application software may or may not be related to player tracking services.

Module 300 may include one or more standard peripheral communication connections (not shown). The logic device 310 may be designed or configured to communicate with interface devices using a standard peripheral connection, such as an USB connector, and using a standard communication protocol, such as USB. The USB standard allows for a number of standard USB connectors that may be used with the present invention. Module 300 may contain a hub connected to the peripheral communication connection and containing a plurality of peripheral communication connections. Details of using a standard peripheral communication connection are described in U.S. Pat. No. 6,251,014, issued Jun. 26, 2001, by Stockdale, et al., entitled, "STANDARD PERIPHERAL COMMUNICATION," which is incorporated herein in its entirety and for all purposes.

Figure 3B:
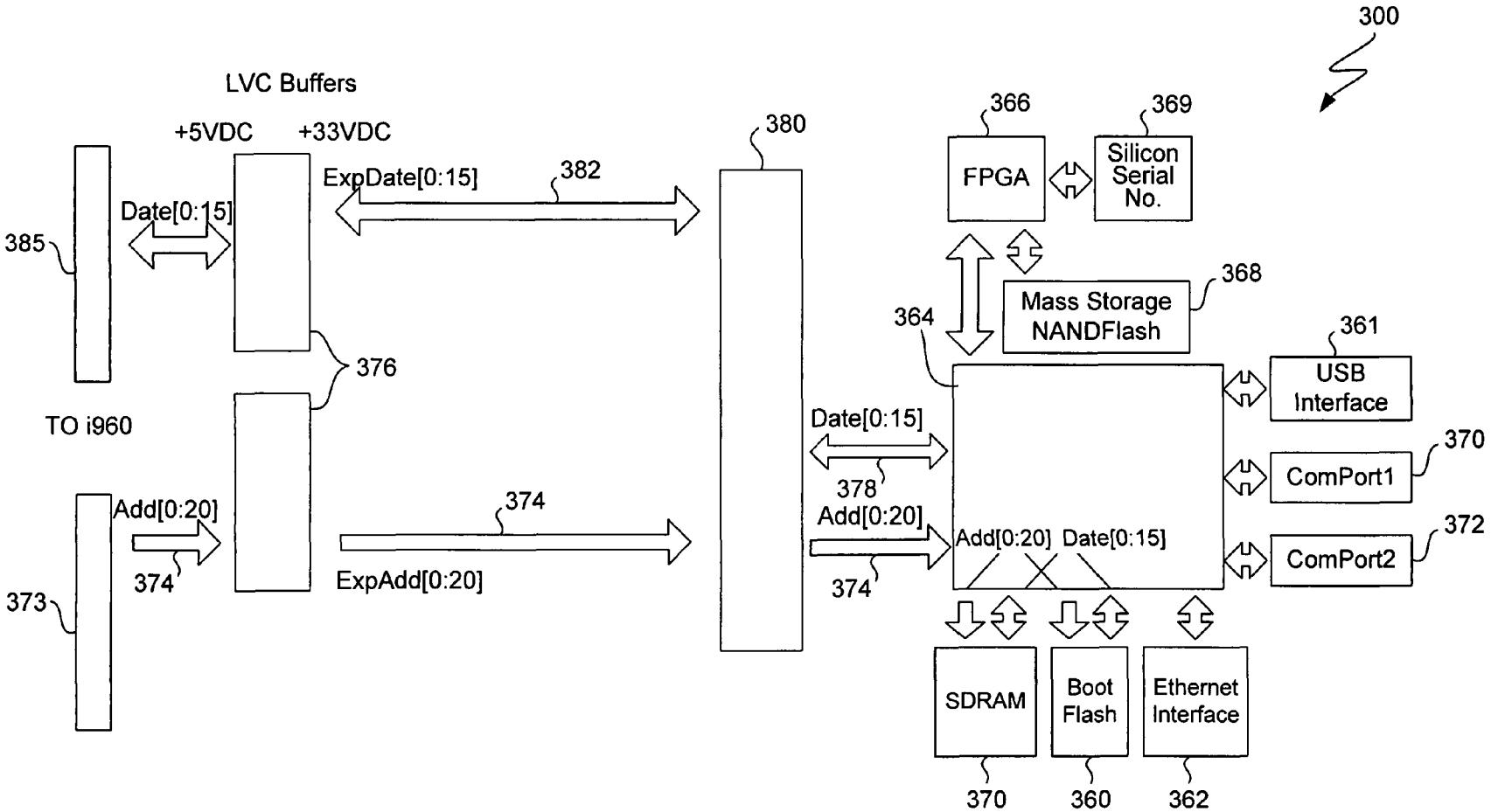
FIG. 3B is a block diagram of the components of a module according to alternative embodiments of the present invention.

FIG. 3B illustrates an alternative embodiment of a module 300 according to the present invention. In this example, flash memory 360 stores software for initializing and configuring module 300.

Data may be downloaded into module 300 via interfaces 361 and 362. Interface 361 is configured for communication with a portable memory device, such as a memory stick or a memory card. Here, interface 361 is a USB interface, but interface 361 could be any convenient interface configured for receiving data from a portable memory device. Interface 362 is configured for receiving data from a network, e.g., from a game server. Although interface 362 is an Ethernet interface in this example, interface 362 could be any convenient interface suitable for communication with a network. Downloaded data are received by CPU 364 from interface 361 and/or interface 362.

Here, processor 366 is configured to apply security policies to data received by CPU 364. For example, processor 366 may authenticate received data, apply decryption algorithms, decompression algorithms, etc. Conversely, processor 366 may add authentication information and apply encryption algorithms, compression algorithms, etc., to transmitted data. In this example, processor 366 is also responsible for monitoring security-related events such as changes to memory, opening the module, etc. Processor 366 could be any type of processor, but is a field programmable gate array in this embodiment. In this example, memory 369 is a non-volatile memory that contains an unique identification code for module 300. This code is preferably included as authentication information in transmissions from module 300, e.g., in requests for gaming software from a game server.

After downloaded data have been authenticated, decrypted, etc., they are stored in memory 368. Here, memory 368 is a NAND flash memory, but memory could be any reliable memory suitable for storing relatively large amounts of data, e.g. a hard drive. Memory 370 is used for storing programs and memory that is quickly accessible by CPU 364, such as software that CPU is currently running. Ports 371 and 372, which are serial communication ports in this example, are configured for communication with other devices, such as a display, another computer, etc.

Connections 373 and 385 are configured for communication with a gaming machine. Preferably, connections 373 and 385 are high-speed parallel connections, so that data can be transferred between module 300 and the gaming machine at high speed. In this example, connector 385 is connected to one of buffers 376 via a 16 bit wide ribbon cable. Similarly, connector 373 is connected to another of buffers 376 via a 20 bit wide ribbon cable.

When a gaming machine is ready to receive data from module 300, the gaming machine sends request 374 to module 300. Preferably, request 374 indicates a specific memory location of the gaming machine to which the data will be written. Buffers 376 perform signal conversion, if necessary, between the type of signal used by the gaming machine and the type of signal used by module 300. In this example, the gaming machine uses 5V signals and the module 300 uses 3.3V signals, so request 374 is converted from 5V to 3.3V.

Request 374 is received at DPRAM 380 and read by CPU 364, which then retrieves requested data from memory 368. The data are transmitted to DPRAM 380. Then the data are read by gaming machine via connection 385. Data can be written to DPRAM 380 by CPU 364 and simultaneously read by the gaming machine.

At some times, the gaming machine will be unable to accept downloaded data, e.g., when a game is being played on the gaming machine. In such circumstances, DPRAM 380 can retain data received from CPU 364 until the gaming machine is ready to accept the downloaded data. Meanwhile, CPU 364 will stop loading the DPRAM until the previously written data buffer has been read by the game machine.

The present invention provides a variety of other methods and devices for upgrading the capabilities of gaming machines. For example, some implementations of the invention provide for gaming software to be executed on a CPU of a module that is in communication with a gaming machine. One such implementation of the invention will now be described with reference to FIG. 4.

Figure 4:
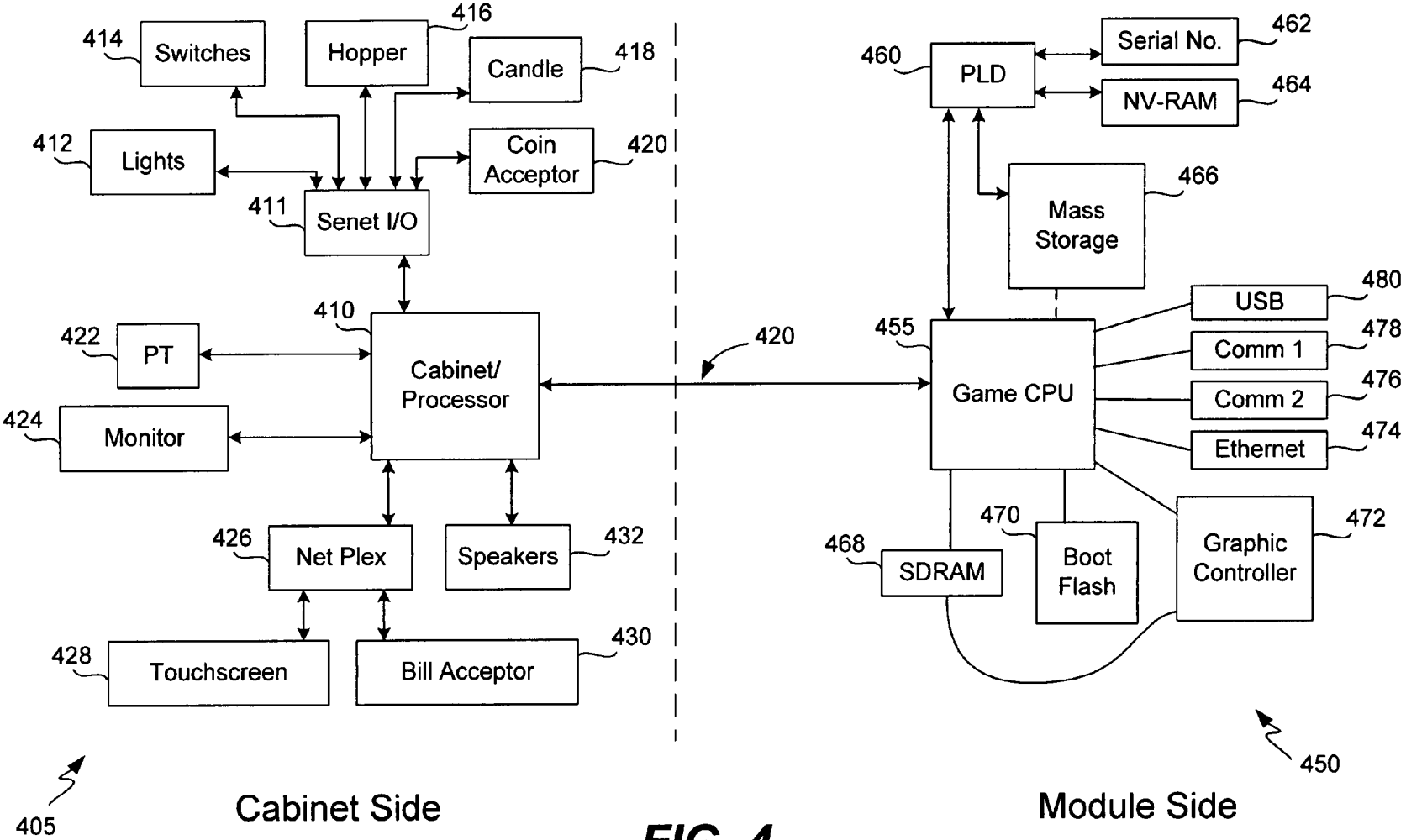
FIG. 4 is a block diagram of the components of a module according to yet other embodiments of the present invention.

FIG. 4 is a block diagram that includes elements in a cabinet 405 and a module 450. Cabinet 405 includes the peripheral devices necessary for game play. These peripheral devices may be those of a legacy machine or may be new peripheral devices. In this example, the peripheral devices of cabinet 405 are those of a pre-existing gaming machine that has had the original CPU board replaced by a new CPU board, as represented by cabinet processor 410.

Cabinet processor 410 is a CPU board that continues to interface with the peripheral devices, but that no longer executes gaming software. Instead, gaming software is executed by game CPU 455 of module 450. Accordingly, unlike many of the previously-described embodiments, there is no need to transfer downloaded gaming software to cabinet 405, via a DPRAM or otherwise. Cabinet processor 410 could be a dedicated processor or IP. In some implementations, cabinet processor 410 is implemented in a programmable logic device such as an FPGA.

Some embodiments retain the legacy CPU as cabinet processor 410 and allow cabinet processor 410 to run in two modes. If it is determined (e.g., by software running on the module) that a player has selected a legacy game, cabinet processor 410 is caused to run in a first mode that allows the legacy CPU to run the legacy game. However, if it is determined that a player has selected another type of game, cabinet processor 410 is caused to run in a second mode wherein it no longer executes gaming software. For example, the legacy CPU could boot up in the first mode as a legacy gaming machine, but could run in the second "cabinet controller" mode according to an interrupt handling routine initiated by a command from the module. For example, functions used in executing gaming software will be shut down and the peripherals may be re-initialized.

Instructions for presenting a game being executed on game CPU 455 are sent from game CPU 455 to cabinet processor 410 via connection 440 and routed accordingly, e.g. to monitor 424, to speakers 432, etc. Cabinet processor 410 monitors the status of peripherals and other components of cabinet 405 and sends information to game CPU 455 when appropriate.

For example, when cabinet processor 410 receives an indicium of credit from bill acceptor 430 and/or coin acceptor 420, cabinet processor 410 will send a message to game CPU 455 indicating "coin in" or the like. Game CPU 455 may respond to such a message with an instruction to monitor 424 and/or speakers 432 to indicate that a player has sufficient credit to begin a game and prompting the player to take an action.

Cabinet processor 410 preferably monitors other aspects of cabinet 405, such as those features described elsewhere herein relating to cabinet integrity and gaming machine security. For example, if someone opens a cabinet door, cabinet processor 410 should respond in a manner calculated to draw attention, e.g., by causing candle 418 to flash red and by sending a message to game CPU 455. Game CPU may, for example, respond by terminating a game, by sending a message to a network administrator via Ethernet port 474, etc.

Game CPU 455 is preferably a more advanced CPU than the CPU that has been replaced by cabinet processor 410. In this example, game CPU 455 is not only a more powerful processor than the CPU removed from the pre-existing gaming machine, but also a CPU that is configured for communication with a network. For example, game CPU 455 may be a processor of the Intel IXP2XX, IXP4XX or IXP2XXX product lines, or a comparable processor made by Motorola, Hitachi, or another chip provider. Game CPU 455 may access such a network, for example, via Ethernet port 474. As discussed elsewhere herein, game CPU 455 may also receive gaming software or other data via USB port 480, e.g., from a portable memory device. Moreover, game CPU 455 can communicate with other devices via one or more of communication ports 476 and 478.

In this implementation, module 450 includes a graphics controller 472 to enable the more complex and interesting visual effects that are desired in modern games of chance. Graphics controller 472 can convert a logical representation of an image stored in memory to a signal that can be used as input for monitor 424. Graphics controller 472 may also provide functionality to manipulate a logical image in memory. Graphics controller 472 may be part of a stand-alone expansion card or an integrated section of a motherboard that includes game CPU 455.

Connection 440 should be capable of transmitting data at a relatively fast rate, in order to facilitate the transfer of information between game CPU 455 and cabinet processor 410. However, connection 410 could take many forms. For example, connection 440 could be a USB connection or an Ethernet connection. Connection 440 could be a wired connection (e.g., a cable) or a wireless connection (e.g., according to the Bluetooth protocol or one of the IEEE 802.11 standards). In some implementations, game CPU 455 and cabinet processor 410 communicate via a PCI, PCI-X or similar protocol. Such a protocol is useful, for example, for implementations in which game CPU 455 is part of a "daughter board" that plugs directly onto the motherboard that includes cabinet processor 410. In some implementations, connection 440 is an Infiniband or a HyperTransport connection.

In this implementation, monitor 424 and speakers 432 will receive instructions via the cabinet processor via the same connections used for the former CPU. Preferably, monitor 424 can utilize a variety of display standards, such as Video Graphics Array ("VGA"), Super VGA ("SVGA"), Extended Graphics Array ("XGA"), Super XGA ("SXGA"), Ultra XGA ("UXGA"), etc., so that a variety of instruction formats may be used to cause a display.

Memory 466, which is a hard drive in this example, could be any reliable memory suitable for storing relatively large amounts of data, such as flash memory mass storage devices. Game software, etc., including but not limited to downloaded information, may be stored in memory 466. Memory 468, which is an SDRAM in this example, is used to store software that game CPU 455 and/or graphics controller 472 are currently running, as well as other information that CPU 455 and/or graphics controller 472 may need to quickly access. Flash memory 470 stores software for initializing and configuring module 450.

Here, the pre-existing gaming machine is an IGT gaming machine that used a proprietary Senet input/output ("I/O") system 411 for communications between the former game CPU board and lights 412, switches 414, hopper 416, candle 418 and coin acceptor 420. Cabinet processor 410 will continue to communicate with these peripherals via the same I/O system 411. Similarly, cabinet processor 410 will continue to communicate with touchscreen 428 and bill acceptor 430 via a proprietary Netplex serial interface 411. In this example, player tracking system 422 has remained part of the legacy cabinet. However, in alternative embodiments, module side 450 may be implemented as a player tracking module that includes a player tracking system.

The functionality provided by the elements shown in FIG. 4 (as well as those of other embodiments described herein) may be provided by embodiments having more or fewer elements. In some such alternative embodiments, a logic device (preferably a programmable logic device such as an FPGA) performs the functionality of game CPU 455, PLD 460, and one or more of SDRAM 468, flash 470, graphics controller 472 and communication modules 474 through 480. In some such implementations, the logic device also provides the functionality of cabinet processor 410.

Dual- and multi-core processors are designed by including two or more full CPU cores within a single processor, thereby enhancing the simultaneous managing of activities. Accordingly, in other alternative embodiments, the functionality of various modules illustrated in FIG. 4 may be apportioned between cores of a dual-core processor such as an AMD Athlon™ 64 X2 Dual-Core processor, an Intel® Pentium® D processor, etc. In some such embodiments, the gaming functions of module 450 are performed by one core and the networking functions of module 450 (e.g., those of element 474) are performed by another core of a dual-core processor. In other such embodiments, the functionality of cabinet processor 410 is performed by one core of a multi-core processor and one or more other cores are providing functions of module 450.

As discussed in greater detail below, some embodiments of the invention involve upgrading not only the CPU, but also some or all of the peripherals of a gaming machine, while still providing the ability to run legacy gaming software. As used herein, the terms "legacy gaming software," "old gaming software" or the like will mean software that was written for a legacy gaming machine that had an older CPU.

For example, IGT has a large library of legacy gaming software that was written for legacy gaming machines that use an Intel i960 (80960) processor as the CPU. Some embodiments of the invention can run both legacy software and software that was written for a gaming machine having a more advanced processor and/or peripheral devices. Such software will sometimes be referenced herein as "native games," "native gaming software," or the like.

In order to run both legacy and native games on the same processor, it will often be necessary to provide software emulation functionality. Such emulation will be necessary if the legacy processor and the new processor do not share a common instruction set, which will often be the case if the processors are not in the same family. As will be appreciated by those of skill in the art, an instruction set describes the aspects of a computer architecture visible to a programmer, such as the instructions, registers, addressing modes, memory architecture, interrupt and exception handling, etc. An instruction set includes all binary codes (sometimes referred to as "opcodes") that are the native form of commands implemented by a particular CPU design. The set of opcodes for a particular instruction set is also known as the "native language" or "machine language" of the CPU.

Every CPU has its own machine language, although there is considerable overlap between some. If CPU "A" understands the full language of CPU "B" A is compatible with B. However, CPU B may not be compatible with CPU A, because A may understand opcodes that B does not. This is often the case when CPU A is a more advanced member of a processor family that includes CPU B. For example, Intel states in its literature that the Intel Pentium 4 processor can execute any opcode that ran on the original 8088 processor (about 5,000 times faster). However, the 8088 could not execute all opcode that can run on the Pentium 4, but only a subset of this opcode.

However, the i960 processor has no modern family member comparable to the Pentium 4. Therefore, gaming software that was written and compiled for an i960 processor will not run on a modern processor without some form of emulation.

Figure 5:
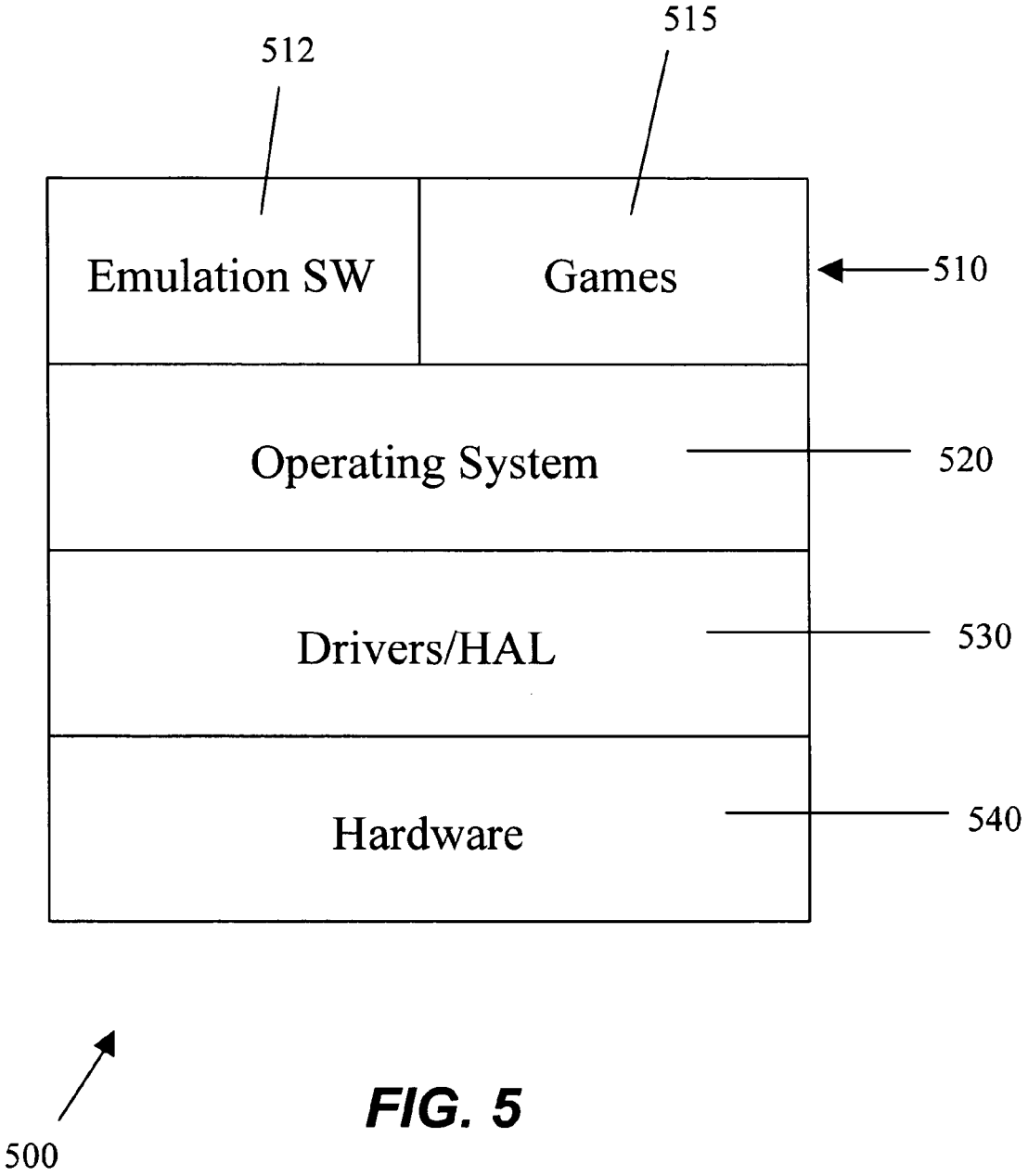
FIG. 5 is a block diagram that illustrates the relationships between various layers of software.

FIG. 5 illustrates stack 500, which represents various software and hardware layers that can be used to implement some emulation-based aspects of the invention. In this stack, application layer includes emulation software 512 and game software 515. In some implementations of the invention, game software 515 includes both legacy games and native games. Here, the legacy games and the native games can run on the same operating system 520. Between hardware layer 540 and operating system 520 is layer 530, which includes drivers and may include a hardware abstraction layer ("HAL"), the latter of which will be described in more detail below.

Emulation software 512 may be enabled for running legacy games on game CPU 455. Emulation software 512 allows legacy software to run on a platform (computer architecture and/or operating system) other than the platform for which the legacy software was written. In this example, emulation software 512 allows the legacy software to run on a more modern platform that includes a more powerful processor (game CPU 455), as compared to the legacy processor (in this example, an i960 processor). Emulation software 512 reproduces the behavior of the legacy platform on game CPU 455 by accepting the same data, interpreting and translating data, executing the same programs, and achieving the same results that are expected by the legacy software.

Here, emulation software 512 only emulates a hardware architecture and the same operating system 520 is used for both native games and non-native games. However, in some implementations, a different operating system may be required for non-native software and the native software. In some such implementations, both the non-native operating system and the non-native game software will be interpreted by the emulation software 512, rather than being run by native hardware.

Figure 6A:
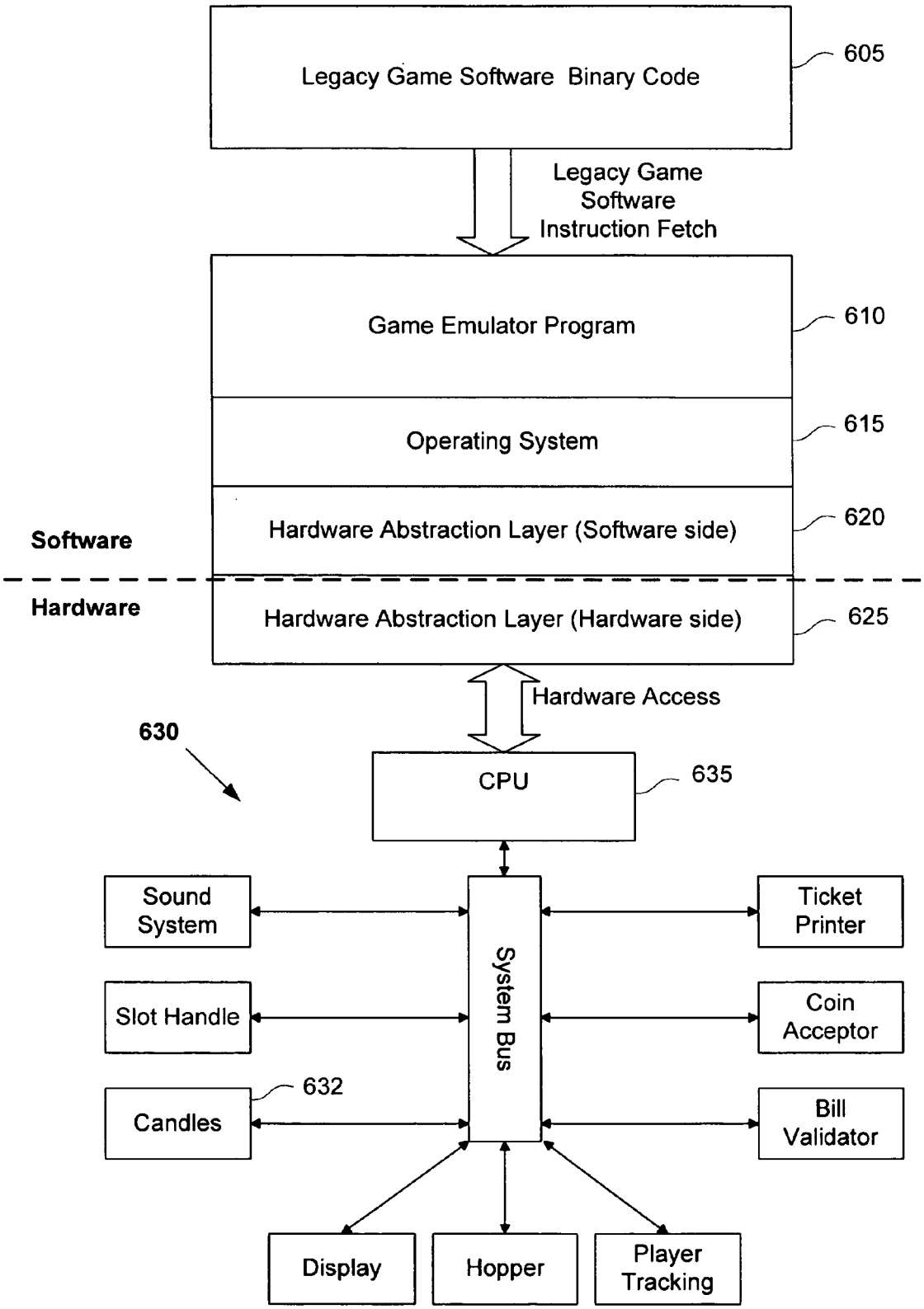
FIG. 6A is a block diagram that illustrates the interaction between software and hardware according to alternative implementations of the invention.

FIG. 6A is a block diagram that illustrates the interrelationships between certain types of hardware and software according to some implementations of the invention. Here, legacy game software 605, game emulator program 610 and operating system 615 are stored in one or more storage devices of module 450. Here, native game code for the module's CPU 635 is in the same software layer as game emulator 610. For example, one or more of these components could be stored in mass storage 466.

Operating system 615 hosts programs, including game emulator program 610, as applications. Operating system 615 could be, for example, Windows XP, Linux, or any suitable operating system.

Game emulator 610 handles the execution of legacy game software 605 on CPU 635, which is disposed in module 450 in this example. Some exemplary functionality of game emulator 610 will be described below with reference to the flow chart of FIG. 6B.

In this example, hardware abstraction layer ("HAL") functionality is performed by a software component 620 and a hardware component 625. Optional HAL software component 620, which is operating system independent, enables access to at least some of hardware components 630. HAL software component 620 can function as a buffer between the operating system and the HAL hardware component 625 and allows the operating system 615 to be changed without changing HAL hardware component 625. In some implementations, HAL software component 620 can communicate with operating system 615 according to a first API of operating system 615 and can communicate with HAL hardware component 625 according to a second API.

Accordingly, HAL software component 620 functions in some respects like a device driver. When a hardware element (e.g., a display, a bill acceptor, etc.) is upgraded or otherwise changed, HAL software component 620 will need to be changed but HAL hardware component 625 may not need to be changed.

Many functions can be performed more quickly by hardware than by software. Therefore, HAL hardware component 625 can improve real-time performance of the overall system, as will be described below.

In some implementations, HAL software component 620 is executed by module 450 and HAL hardware component 625 is also part of module 450. However, part or all of HAL hardware component 625 could be disposed within legacy cabinet 405. For example, HAL hardware component 625 could be part of cabinet processor 410. In some such embodiments, cabinet processor 410 is implemented via a PLD, such as an FPGA, and the functions of HAL hardware component 625 are performed by the PLD.

When a particular legacy game needs to be run, game emulator 610 open the binary code for that game and load the binary code into SDRAM 468 for execution by game CPU 455. One of the important roles of game emulator 610 is processing hardware access requests from legacy game software 605 into native hardware access. If the legacy game software wanted to activate one of the hardware components 630 of a gaming machine, legacy game software 605 would write to a particular address. For example, if legacy game software 605 wanted to turn on one of candles 632, legacy game software 605 would write to a particular address. Game emulator 610 would determine, based on that address, that the legacy game wanted to illuminate one of candles 632. Game emulator 610 would make an API call, via operating system 615 and at least one of HALs 620 and 625, to access the candle.

Figure 6B:
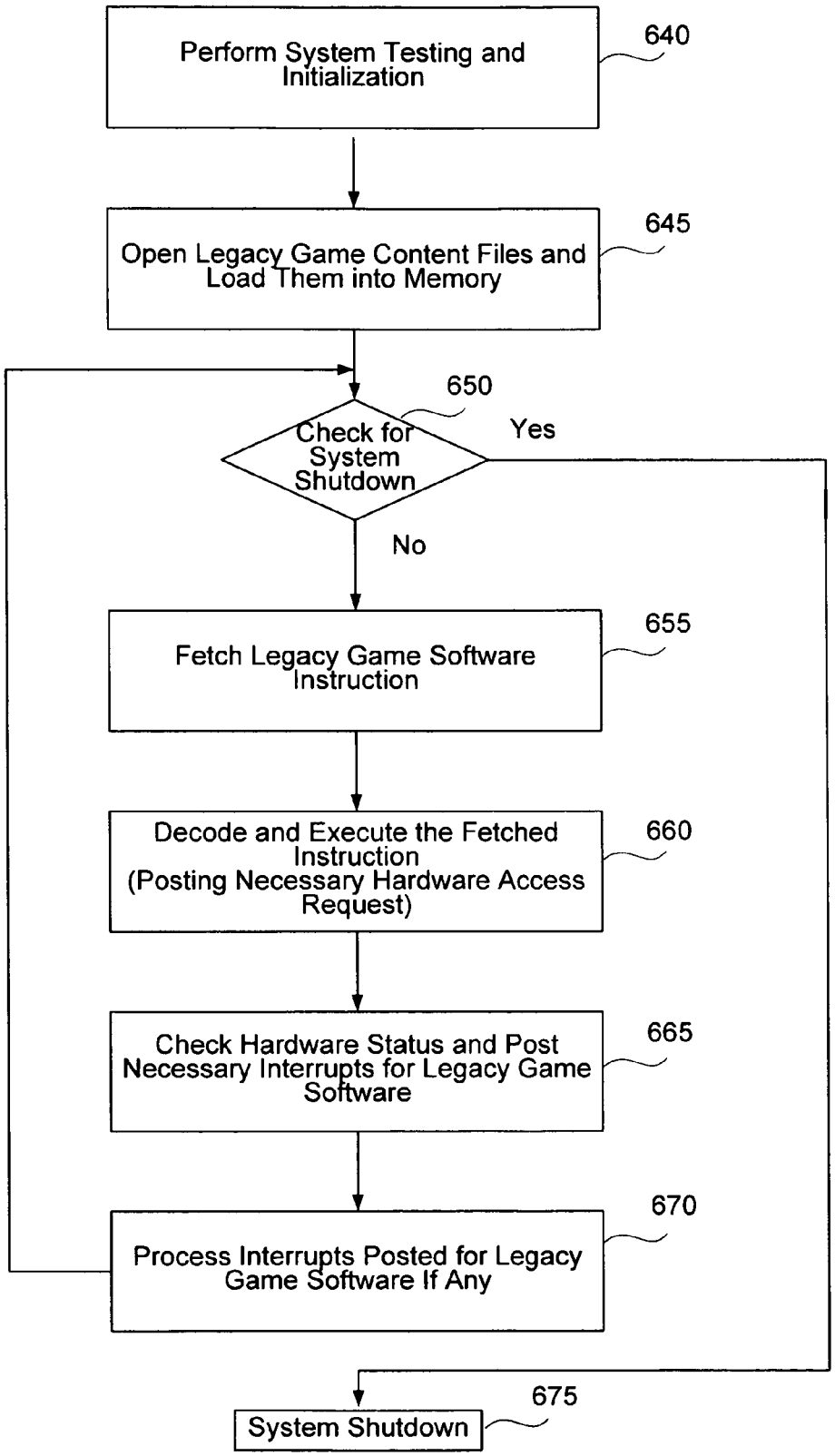
FIG. 6B is a flow chart that outlines an emulation process according to some implementations of the invention.

The flow chart of FIG. 6B describes a simplified process flow of game emulator 610 according to some implementations of the invention. In step 640, game emulator 610 performs some system testing and initialization. Game emulator 610 then opens the legacy game content files corresponding to a desired legacy game, including the binary code for the software as well as the graphics and sound information files, and loads the legacy game content files into memory having an access speed suitable for execution, e.g., into SDRAM 468. (Step 645.)

In step 650, game emulator 610 checks for a system shutdown. A system shutdown could have a number of different causes, including but not limited to a power shutdown, a command (e.g., from a network administrator or a server) that tells the gaming machine to shut down, etc. Such a command may be necessary, for example, when a gaming machine having a single CPU core is receiving a downloaded game.

If there is no shutdown, the process continues to step 655, wherein a legacy game software instruction is fetched. The legacy game software instruction is decoded and executed in step 660. Any necessary hardware access requests are also posted. The decoding step is required because the legacy game software instruction will be in the native form of commands implemented by a particular legacy CPU design. Therefore, the legacy game software instruction will be decoded and mapped to a corresponding instruction from the instruction set of the module's CPU.

As previously noted, the present assignee has a large library of games written for the Intel i960 CPU. Accordingly, the legacy game software instruction may be, for example, from the instruction set of the Intel i960 CPU. However, the methods of the present invention may be used for any legacy game software.

Hardware status should be checked frequently in order to avoid delay and provide satisfactory performance. For example, if a player pushes a button of the gaming machine, any response to the button push should occur in a very short time; it would not be desirable to make the player wait until a large number of operations are completed before a response is made. In this exemplary implementation, the hardware status is checked after the execution of each fetched instruction and any necessary interrupts are posted and processed. (Steps 665 and 670.)

However, in other implementations, steps 665 and 670 occur after more than one legacy game instruction is fetched, decoded and executed. For example, steps 665 and 670 may occur after 10 legacy game instructions, 100 legacy game instructions, or even more legacy game instructions are fetched, decoded and executed. In still other implementations, steps 665 and 670 occur after the passage of a predetermined period of time.

The hardware status may be monitored and interrupts could be processed, e.g., by CPU 455 or PLD 460. In some such implementations, hardware status may be monitored by a HAL implemented, at least in part, by PLD 460. Such a HAL could take care of such functions very quickly, thereby allowing gaming CPU 455 to be devoted to higher-level tasks, or at least to other aspects of game emulation. This division of labor between a HAL and the gaming CPU 455 can make the overall execution more like that of a real-time system, even when the game emulator program 610 is running on an operating system 615 that is not a real-time operating system. In multi-core implementations, hardware status may be monitored, and necessary hardware responses can be controlled, by a first core and gaming software can be executed by a second core.

After step 670, the process once again checks for a system shutdown (step 650) before fetching the next legacy game instruction. However, in alternative implementations, step 650 is performed after more than one instruction is fetched, decoded and executed, and/or after the passage of a predetermined period of time. If there is no system shutdown indication, the next legacy game instruction is fetched, decoded and executed. In some implementations, a time delay will intentionally be introduced before processing the next legacy game instruction, due to the relatively faster processing speed of game CPU 455 as compared to a legacy CPU.

Some implementations of the invention, allow a CPU have 2 modes of operation, "emulation mode" and "native mode." When running native game software that requires no emulation, the CPU is running in native mode. Accordingly, emulation software 512 is not enabled. When running non-native game software that requires emulation, emulation software 512 is enabled.

Figure 7:
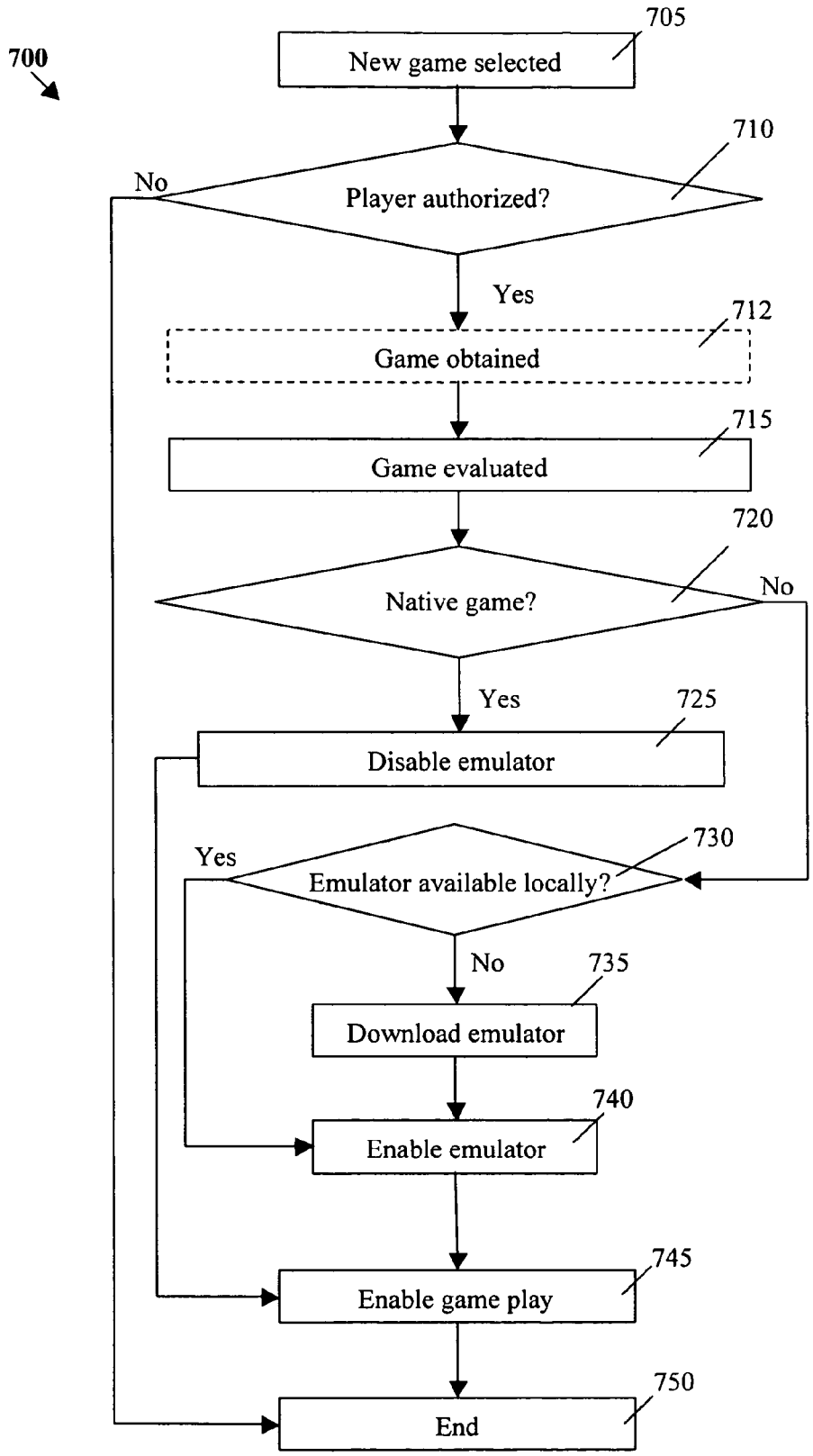
FIG. 7 is a flow chart that outlines the use of some embodiments of the invention that games to be played in emulation mode or native mode.

Method 700 of FIG. 7 outlines one such implementation of the invention. In step 705, a new game is selected, e.g., when a player touches an area of a touchscreen that corresponds with a desired game.

In step 710, it is determined whether the player is authorized to play the game. Step 710 may involve any of various processes, including a determination of whether the player has inserted indicia of credit into a gaming machine, determining whether a player is in a jurisdiction wherein the selected game may be played, etc., as described elsewhere herein. In some implementations, it will be determined in step 710 that some aspects of a game may be played in a jurisdiction but others may not. Accordingly, some features may be enabled or disabled, according to the jurisdiction. For example, if a particular type of bonus feature is not legal in New Jersey, the player's jurisdiction, then the bonus feature will be disabled. U.S. patent application Ser. No. 11/155,052, entitled "Universal System Mediation Within Gaming Environments" and filed Jun. 17, 2005, describes relevant methods and devices and is hereby incorporated by reference.

If the player is not authorized to play the game, the process ends (step 740). The player may choose to select another game (step 705) and try again.

If the player is authorized to play the game, the game is obtained, if necessary, in step 712. For example, if the game is not already stored in a local memory, the game may be downloaded from a game server, from a portable memory device, etc. In step 715, the selected game is evaluated to determine whether the game may be run in native mode or whether it will need to be run in a non-native mode requiring emulation. "Non-native" games may include both legacy games, as described elsewhere herein, and also games that were simply written for another type of gaming machine. In some implementations, non-native games include games written for execution on a gaming machine produced by another company. For example, some such implementations allow for an IGT gaming machine to run not only IGT games, but also to run Bally games, WMS games, Aristocrat games, etc.

In some implementations, a header or a flag in the game file indicates whether the game should be run in native mode or in emulation mode. However, an indication of whether the game should be run in emulation mode may be an express indication or an implied indication. For example, non-native software may have certain characteristics that would not be found in native software and vice versa. For example, a native game may communicate with a printer via a USB connection, whereas a non-native game may use NetPlex.

In step 720, a determination is made, based on the evaluation in step 715, as to whether the game is a native game or a non-native game. If the game is a non-native game, it is determined whether emulation software is locally available for running the non-native game. (Step 730). If appropriate emulation software is locally available, that software is enabled. (Step 740.) If the proper emulation software is not locally available, the software is downloaded (step 735) and then enabled (step 740). The proper type of emulation software may be determined, for example, by a gaming server according to information from the gaming machine indicating what type of CPU it uses, what peripherals it has, etc.

As noted above, some implementations of the invention provide for gaming software from various sources, including gaming software that has been provided by different companies, to be run on the same gaming machine. Accordingly, it will sometimes be the case that gaming software and emulation software will be downloaded from different servers using different communication protocols. For example, IGT typically uses the SuperSAS® protocol for communications between servers and gaming machines, whereas other companies may use Best of Breed® ("BOB") protocol or another protocol. U.S. patent application Ser. No. 11/155,052, which has been incorporated by reference, describes relevant methods and devices.

Depending on the hardware configuration expected by the non-native game, other forms of emulation may be required, such as emulation that may be provided by a HAL in some implementations. This feature will be discussed in more detail below.

However, if it is determined in step 720 that the game is a native game, emulation software is not enabled. Either way, game play is enabled in step 745. It will be appreciated that having the flexibility of playing both native and non-native games on the same gaming machine offers a player a great deal of flexibility and a great many options, particularly if the gaming machine can download selected games and emulation software.

A non-native game may expect to receive such an indication from a peripheral device in a particular format. For example, legacy gaming machines having an i960 CPU have a communication system that connects to a variety of different peripherals: a bill validator, a coin hopper, different serial ports. The i960 CPU sees this world in a particular fashion. For example, a legacy "960" game written for an IGT gaming machine having an i960 CPU may expect to receive credit information from a bill acceptor in a proprietary Netplex format.

If we run legacy games on another processor via software emulation, the new processor will probably not see the peripherals in the same way, in part because the bus architecture will probably not be the same as that of the i960 chip. However, for the legacy software to run on the new processor, the legacy software needs to communicate with the peripherals in the same way as the legacy software would if the code were running on an i960 chip.

Moreover, it would be desirable to allow for greater flexibility in the deployment of peripheral devices for gaming machines while still providing the ability to play non-native games. It would be a great benefit if peripheral devices could be upgraded as more advanced technology is developed and becomes cost-effective for deployment in gaming machines. For example, even if a non-native game were written to be displayed on a cathode ray tube, it would be desirable to have the option of playing the non-native game on a newer gaming machine having a liquid crystal display or a plasma display.

Figure 8:
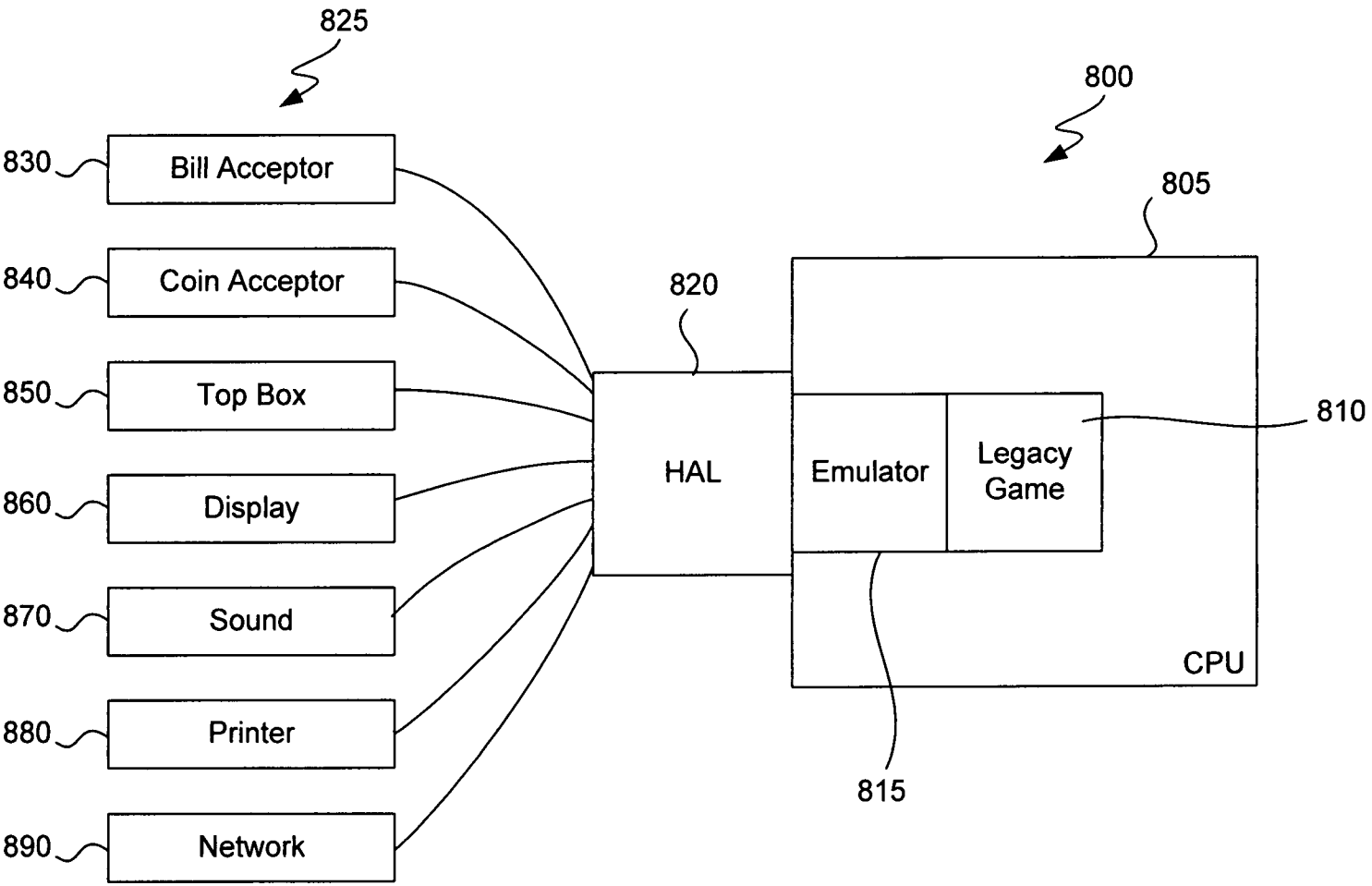
FIG. 8 is a schematic diagram that illustrates both software emulation and hardware abstraction.

FIG. 8 is a block diagram that illustrates an embodiment of the invention that can provide such flexibility. System 800 includes CPU 805 that can run legacy games 810 with the aid of software emulator 815. HAL 820 mediates communications between CPU 805 and various peripherals 825. These peripherals include bill acceptor 830, coin acceptor 840, top box 850, display 860, sound system 870 and printer 880.

HAL 820 is an abstraction between the software and the hardware. HAL 820 allows an interface to be manipulated in order to make peripherals (including new peripherals that the old gaming machine never had) "look like" the old type of peripherals with which legacy game 810 expects to interact. Legacy game 810 sees the proper bit map, registers, or whatever it expects to see with regard to a peripheral.

HAL 820 may be implemented as hardware and/or software. In some preferred implementations, HAL 820 is implemented in a programmable logic device (PLD") such as a field programmable gate array ("FPGA") or a complex programmable logic device ("CPLD"). (In some implementations of the invention, PLD 460 of FIG. 4 provides a HAL.) Because PLDs are implemented in hardware, but written as software language, PLDs allow a lot of flexibility with respect to implementation. For example, a PLD allows changes to be made "on the fly," if necessary. For example, a PLD could be modified when a particular peripheral device is upgraded. Such changes cannot be made in a HAL implemented with hard-coded logic using one-time programmable devices.

According to some implementations of the invention, legacy games 810 are written for an IGT gaming machine having an i960 CPU. These games expect to receive credit information from bill acceptor 830 via a serial Netplex interface. HAL 820 allows the flexibility of changing to a new interface, e.g. a USB interface. In this example, HAL 820 is configured translate standard USB signaling to Netplex and vice versa. Accordingly, the USB interface is presented to legacy game 810 as a Netplex interface. Any or all of peripherals 825 may be changed in the same way, as long as HAL 820 is modified accordingly. HAL 820 would perform whatever protocol mediation is required in order to communicate transparently with the new peripherals. HAL 820 may receive software and/or data via network 890 for this purpose.

Figure 9:
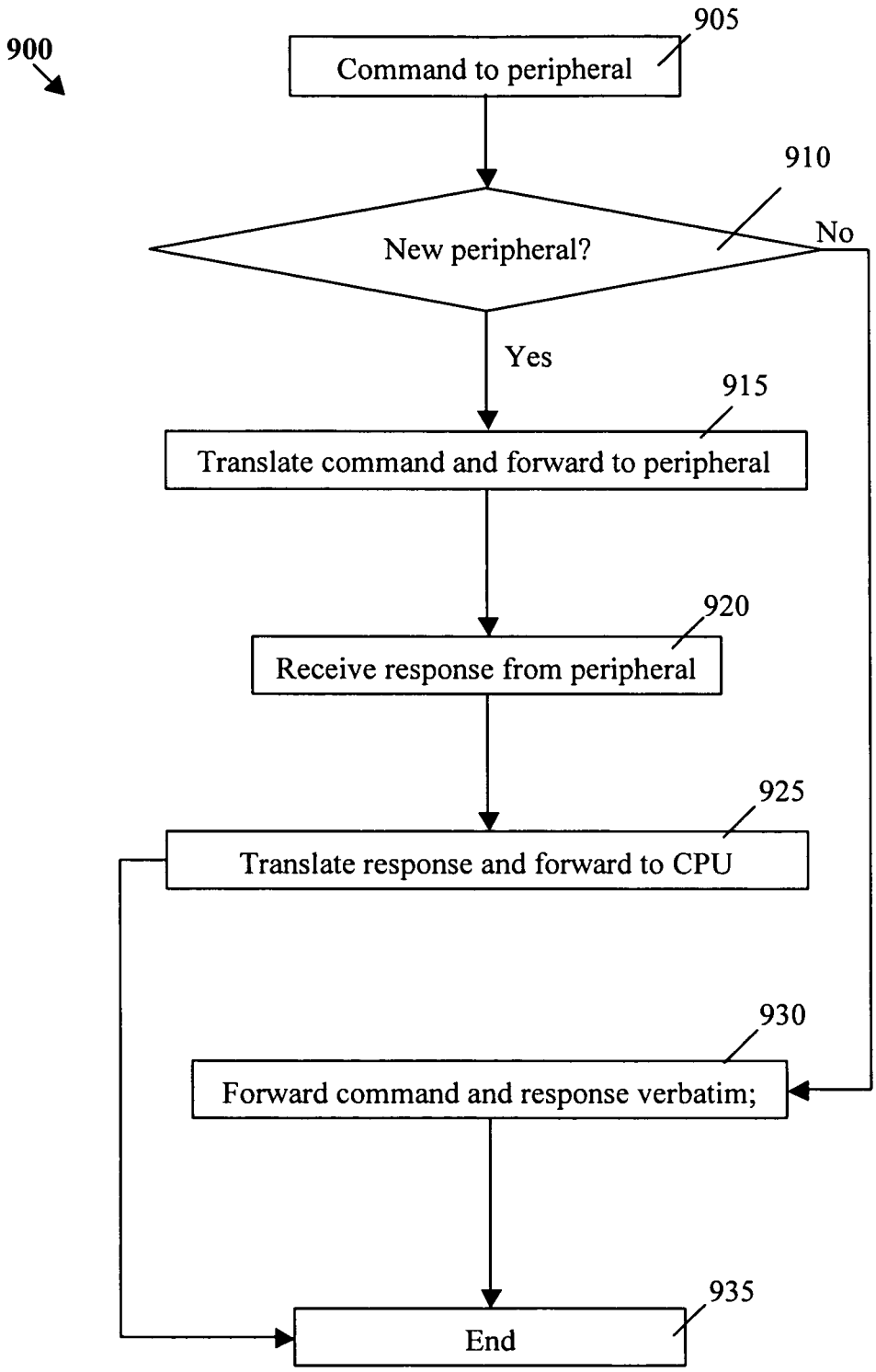
FIG. 9 is a flow chart that outlines a hardware abstraction method of the present invention.

FIG. 9 is a flow chart that outlines method 900 according to one exemplary implementation of a HAL according to the present invention. In step 905, gaming software gives a command to a peripheral in response to an event that takes place during a game. In this example, the command is to make a light flash on the gaming machine. In step 910, it is determined (e.g., by a logic device implementing a HAL) whether the peripheral to which the command is directed is in use. If the peripheral is still in use, the command is forwarded to the peripheral verbatim (step 930). Similarly, any response from the peripheral is forwarded back to the CPU without change.

However, in this example, the light to which the command is directed is not in use on the gaming machine. Accordingly, a HAL translates the command before it is forwarded. (Step 915.) In this example, the HAL provides an interface with a new gaming machine that no longer includes the light. However, the new gaming machine has a video display. Therefore, the HAL translates the command to make the light flash into a command to produce an interesting video display (a flashing screen, an interesting image, a text message, etc.) (Step 915.) In step 920, the display returns a response indicating that the interesting video display has been produced. In step 925, the HAL returns a response to the CPU indicating that the light is flashing.

In a similar fashion, non-native code can be run even without the peripheral devices for which the code was written. In some such implementations, peripheral mediation hardware and/or software may be required. In some such implementations, peripheral mediation software may be downloaded as needed, e.g., as described above with reference to FIG. 7. For example, if a gaming server receives a request to play a game involving a joystick from a gaming machine that does not have a joystick, the gaming server may determine whether the gaming machine has other features (e.g., left/right and up/down buttons, or similar features) that could be used in lieu of the joystick. If so, the corresponding peripheral mediation software can be provided along with the game. If not, the game will not be provided.

Figure 10:
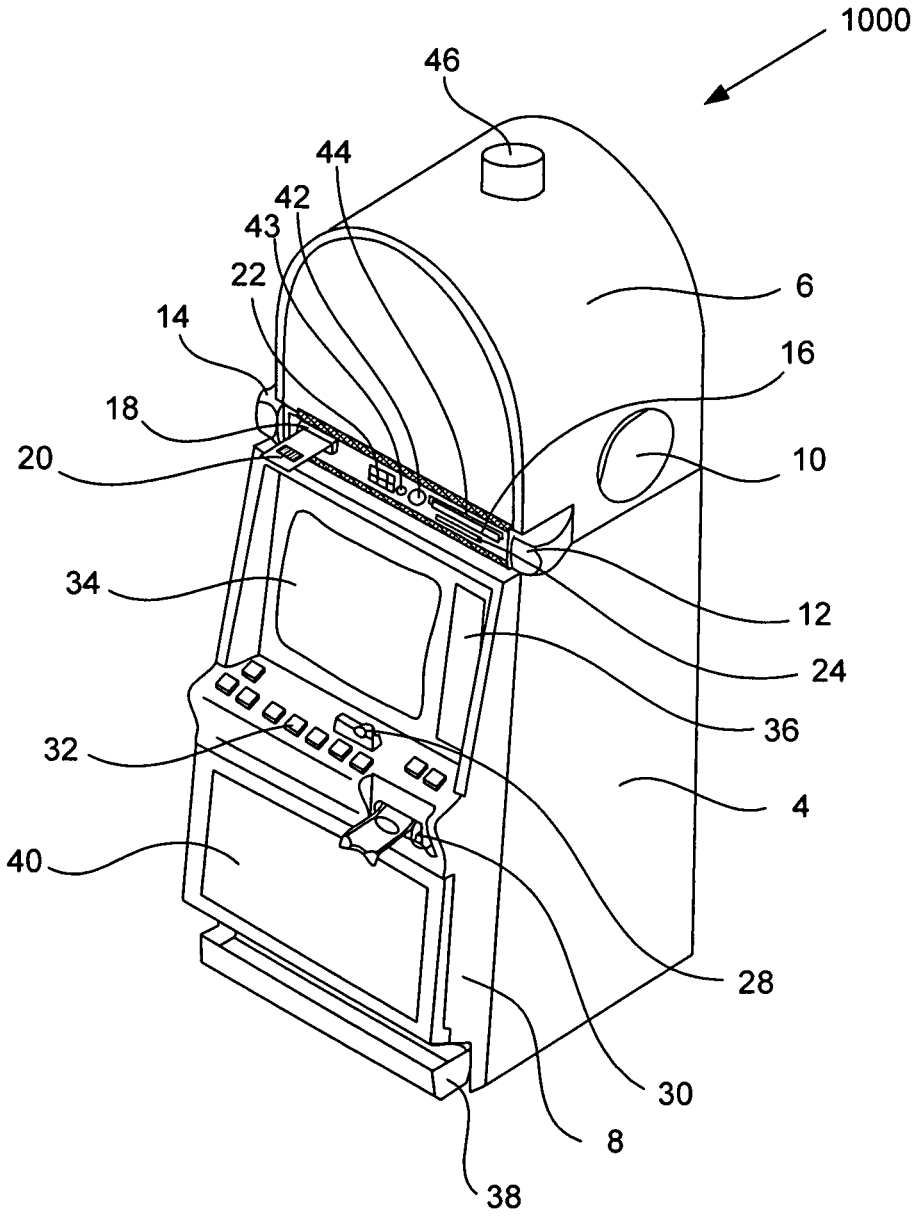
FIG. 10 is a perspective drawing of a video gaming machine of the present invention.

In FIG. 10, a video gaming machine 1000 of the present invention is shown. Machine 1000 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 may be a cathode ray tube, high resolution flat-panel LCD, or other conventional electronically controlled video monitor. The information panel 36 may be a back-lit, silk screened glass panel with lettering to indicate general game information including, for example, the number of coins played. The bill validator 30, player-input switches 32, video display monitor 34, and information panel are devices used to play a game on the game machine 1000. The devices are controlled by circuitry housed inside the main cabinet 4 of the machine 1000. Many possible games, including traditional slot games, video slot games, video poker, video black jack, video keno, video pachinko, lottery games and other games of chance as well as bonus games may be provided with gaming machines of this invention.

The gaming machine 1000 includes a top box 6, which sits on top of the main cabinet 4. The top box 6 houses a number of devices, which may be used to add features to a game being played on the gaming machine 1000, including speakers 10, 12, 14, a ticket printer 18 which may print bar-coded tickets 20 used as cashless instruments. Here, a module mounted within the top box 6 includes player tracking capabilities and enhanced data downloading capabilities, as described above. A key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. A player playing a game on the gaming machine 1000 or a person near the gaming machine may view the light patterns from the light panel 216. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 1000 is but one example from a wide range of gaming machine designs on which the present invention may be implemented. For example, not all suitable gaming machines have top boxes or player tracking features. Further, some gaming machines have two or more game displays, which may be mechanical and/or video. Some gaming machines are designed for bar tables and have displays that face upwards. Still further, some machines may be designed entirely for cashless systems. Such machines may or may not include such features as bill validators, coin acceptors and coin trays. Instead, they may have only ticket readers, card readers and ticket dispensers. Those of skill in the art will understand that various aspects of the present invention can be deployed on gaming machines now available or hereafter developed.

Returning to the example of FIG. 10, when a user wishes to play the gaming machine 1000, he or she inserts cash through the coin acceptor 28 or bill validator 30. In addition, the player may use a cashless instrument of some type to register credits on the gaming machine 1000. For example, the bill validator 30 may accept a printed ticket voucher, including 20, as an indicium of credit. As another example, the card reader 24 may accept a debit card or a smart card containing cash or credit information that may be used to register credits on the gaming machine.

Prior to beginning a game play session on the gaming machine 1000, a player may insert a player tracking card into the card reader 24 to initiate a player tracking session. In some embodiments, after inserting the card, the player may be visually prompted on the display screen 16 or aurally prompted using the speaker to enter identification information such as a PIN code using the key pad 22. Typically, the player tracking card may remain in the card reader 24 during the game play session. As described in co-pending U.S. patent application Ser. No. 10/214,936, filed Aug. 6, 2002 and entitled "Flexible Loyalty Points Programs," various other types of player tracking cards, devices and readers may be used. (Application Ser. No. 10/214,936 is incorporated by reference for all purposes.) Moreover, other identification information (e.g., biometric information) may be captured.

In a player tracking session on the gaming machine, features of the player's game play during a game play session on the gaming machine, such as an amount wagered during the game play session, may be converted to player tracking points and stored in the player's player tracking account on a player tracking server. Later, accumulated player tracking points may be redeemed for rewards or "comps" for the player such as free meals or free rooms. Many details of player tracking devices and methods not described herein are set forth in U.S. patent application Ser. No. 10/246,373, entitled "Player Tracking Communication Mechanisms In A Gaming Machine," which has been incorporated herein by reference for all purposes.

During the course of a game, a player may be required to make a number of decisions, which affect the outcome of the game. For example, a player may vary his or her wager on a particular game, select a prize for a particular game, or make game decisions which affect the outcome of a particular game. The player may make these choices using the player-input switches 32, the video display screen 34 or using some other device which enables a player to input information into the gaming machine. Certain player choices may be captured by player tracking software loaded in a memory inside of the gaming machine. For example, the rate at which a player plays a game or the amount a player bets on each game may be captured by the player tracking software.

During certain game events, the gaming machine 1000 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 1000, from lights behind the belly glass 40 or the light panel on the player tracking unit 44.

After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 1000. In some embodiments, these tickets may be used by a game player to obtain game services. In addition, when the player has inserted a player tracking card in the card reader to initiate a player tracking session, to prevent the player from leaving or "abandoning" their card in the card reader 24, a voice message, such as "please remove your card," may be projected from the sound projection device 44.

Figure 11:
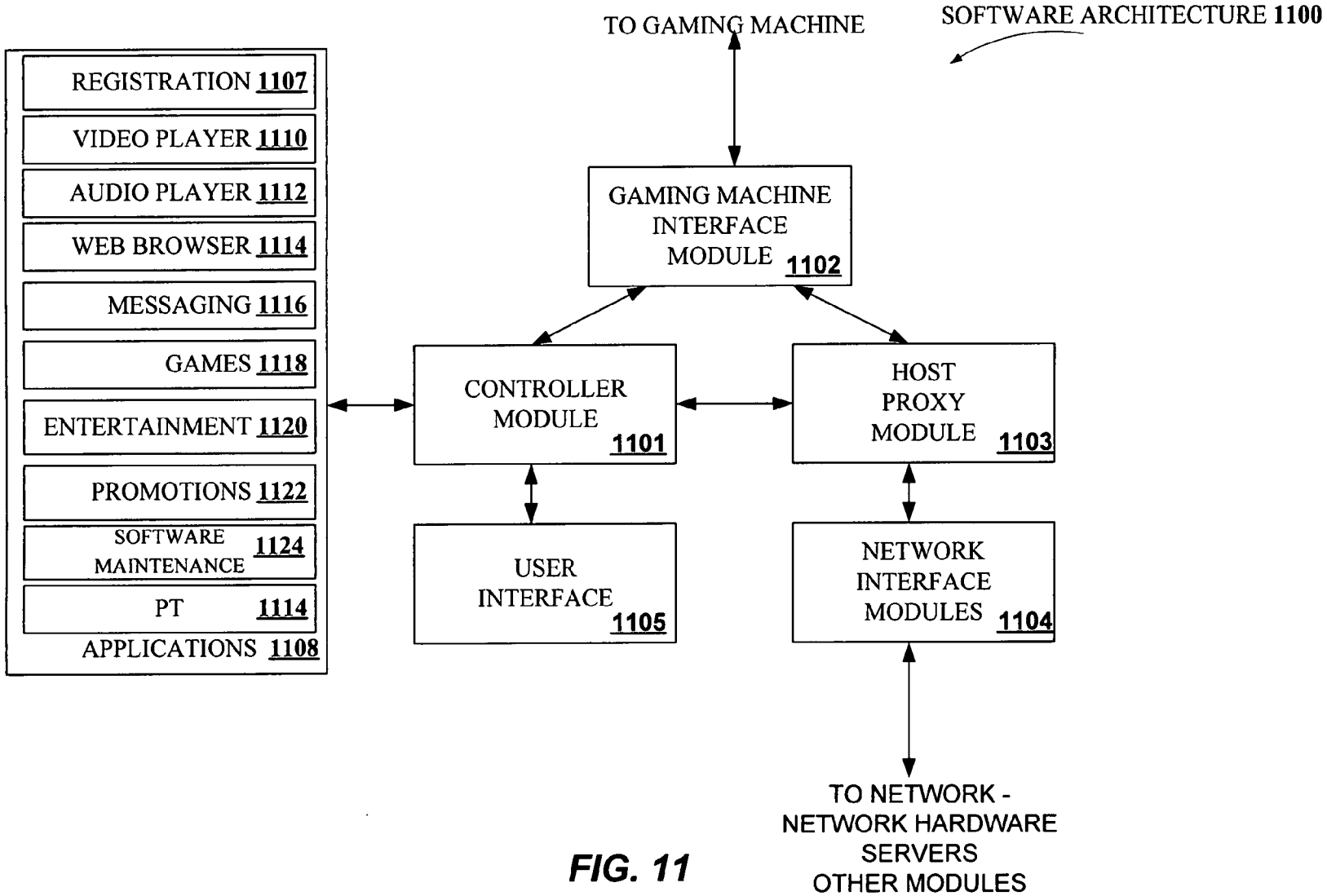
FIG. 11 is a block diagram depicting exemplary software architecture according to some implementations of the invention.

FIG. 11 is a block diagram of a software architecture 1100 for some modules of the present invention. The modular architecture may allow different components of the software to be upgraded and bugs to be fixed by replacing only affected components, e.g. via a download from a portable memory device or a server. In addition, the supported features in the module may be upgraded by downloading new application software 1108 or upgrading existing application software on the unit.

The controller module 1101 may utilize an operating system to schedule and prioritize tasks executed by the module, including the loading of software into RAM for execution. As used herein, the term "RAM" includes both read-only memory and read/write memory. The applications 1108 are examples of software that may be loaded into RAM for execution by the controller module 1101. The controller module 1101 may send information to the other software modules, such as a gaming machine interface module 1102, a host proxy module 1103, a user interface 1105 and the various applications 1108 and receive information from these software modules. The different software modules may communicate with the controller module 1101 and each other via well-defined application program interfaces (APIs).

The gaming machine interface module 1102 may include logic for communicating with a gaming machine, with peripheral devices in a gaming machine cabinet and/or with a cabinet processor or the like, e.g., as described with reference to FIG. 4. For convenience, all such communications will be referred to in this discussion as being made with a "gaming machine" or a "host gaming machine." These communications may be made using proprietary and non-proprietary communication protocols, e.g., as described elsewhere herein.

The gaming machine interface module 1102 may be used to send data, commands, etc. to the host gaming machine and receive data, responses, etc. from the host gaming machine. The data received from the host gaming machine may include (but is not limited to) gaming machine identification information, information regarding indicia of credit received by the gaming machine, gaming machine software information, gaming machine status information and metering information on the gaming machine. In some implementations, the module is able to download software to the gaming machine via the gaming machine interface module 1102.

The host proxy module 1103 may be used to manage communications between the module and devices that may communicate with the module via a network. The gaming devices may include but are not limited to network devices such as servers, other modules, other gaming machines and data collection units. The communications with different devices may be enabled by a plurality of network interface modules 1104. The network interface modules may allow the module to communicate using communication protocols required by different devices. For instance, player tracking/accounting servers from different manufacturers may use different communication protocols.

The controller module 1101 may execute a number of applications 1108. Some player tracking applications 1114 have been described elsewhere herein. In other embodiments, the controller module 1101 may include logic for automatically registering and deregistering the module and/or the host gaming machine with one or more remote servers. Before the module beginning communications with a remote server, the remote server typically requires information used to recognize the module and the host gaming machine. Traditionally, information needed by a remote server database to recognize a particular gaming machine has been entered into the remote server in a manual process. However, the registration logic 1107 executed by the controller module 1101 may be used to automatically transfer the information required for gaming machine registration to one or more remote servers. Details of one exemplary registration and deregistration method are described with respect to FIGS. 12 and 13 of U.S. patent application Ser. No. 10/246,373, entitled "Player Tracking Communication Mechanisms In A Gaming Machine," which has been incorporated herein by reference for all purposes.

In some embodiments, the controller module 1101 can execute one or more software applications allowing the module to perform software maintenance and/or to change content that may be used by the module, the gaming machine, etc. In some implementations, the software applications of controller module 1101 may be performed without any user input. In other implementations the software applications may facilitate a process of downloading data, such as desired gaming software, software upgrades, content, etc. In some implementations of the invention, some such downloads are performed in response to a player's selection of a desired game that is not stored in a local memory.

As another example, software maintenance application 1124 may allow the controller module 1101 to determine versions of software currently in use on the module, the gaming machine, a peripheral, etc. In some implementations of the invention, controller module 1101 logs into a server and compares the versions of software and/or content currently in local memory with software versions available on a server or a portable memory device to determine when an upgrade is needed. Controller module 1101 may also compare software and/or content received from a portable memory device with software currently in use to determine whether an upgrade would be desirable. The software and/or content may be upgraded to fix errors and/or to add new features.

Figure 12:
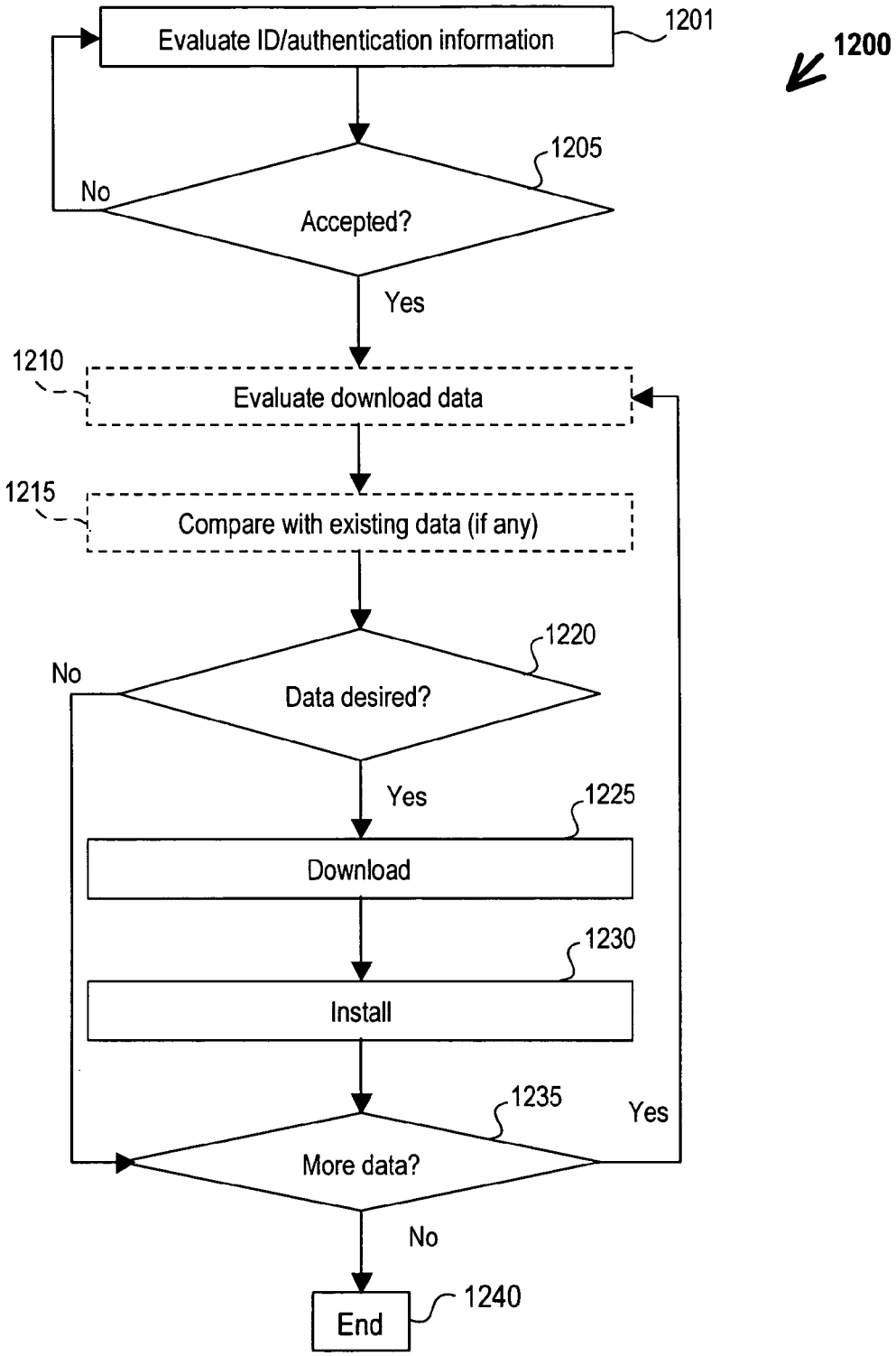
FIG. 12 is a flow chart that outlines a method of downloading and installing data according to some implementations of the invention.

One such process is outlined in FIG. 12. It will be appreciated that the steps of method 1200 may not always be performed in the order shown in FIG. 12, that some steps may be omitted and that additional steps may be performed within the scope of the present invention. Method 1200 begins with a determination (e.g., by the controller module) as to whether it is time to evaluate local data and to determine whether desired gaming software, software upgrades, content, etc., should be downloaded. (Step 1201.)

According to some implementations, locally stored data may be evaluated to determine whether a replacement or an upgrade would be desirable. This determination may be made in various ways, such as but not limited to 1) in response to a time factor, such as checking for upgrades during a predetermined time interval; 2) in response to a command received from a server; or 3) in response to an input received at the module and/or the host machine.

The input received at the module may be generated by an operator. For example, software maintenance and/or downloading of data can be initiated by the insertion of a portable memory device containing software or by other operator input, e.g., from key pad 220, by voice recognition of a command received by microphone 207, etc.

In other implementations of the invention, locally stored data may be evaluated to determine whether software for a desired game is available. This determination may be made, for example, in response to a player's request to play a particular game. Even if a desired game is stored in local memory, in some implementations of the invention, it is nonetheless determined in method 1200 whether a more recent version of the game is available.

In step 1203, authentication information and/or identity information is evaluated. In some implementations, the identification/authentication process is an automated process that is initiated when it is determined that a game selected by a player is not stored in local memory. For example, a module may make a request to a game server for a particular game and the game server or an associated server (e.g., an authentication server) may evaluate ID and/or authentication information submitted with the request.

In other implementations, an operator may engage a portable memory device with the module. In some such implementations, an operator enters a password for identification purposes (step 1203) and the password is accepted or rejected (step 1205). In some implementations, the portable memory device includes identification information regarding one or more operators who are permitted to download data to the module. The identification information could be, for example, biometric information that can be compared to biometric information received from the operator, e.g. by a fingerprint scan or a retinal scan. In some implementations, the module includes a device for receiving such biometric information. In other implementations, the portable memory device itself includes a sensor for receiving biometric information.

Whether the data are to be received from a portable memory device or a network device, the data are preferably authenticated prior to downloading. This authentication process may be via any method known by those of skill in the art. Preferably, the player, operator or machine is given more than one opportunity for identification. However, in some implementations, after a predetermined number of opportunities, the process ends.

If the authentication/ID process completes successfully, method 1200 continues. For example, version information of available software and/or content may be determined (step 1210) and compared with software and/or content currently stored in local memory (step 1215). For example, the module may survey software and/or content that is being used on the module and the host gaming machine, compare the software being used with software available elsewhere, e.g., from a network device or a portable memory device. In some implementations, the software and/or content being evaluated is not currently in use, but is currently in local memory. However, in some instances, there is no locally stored version of the data, so step 1215 is not necessary.

If it would be desirable to download the data (e.g., if a newer version of software is available), the data are downloaded to a local memory (step 1225). In some implementations, the data are downloaded (at least temporarily) to a memory of a module, such as memory 368 of module 300 (see FIG. 3B) or memory 466 of module 450 (see FIG. 4). Even if the data will later be transferred to a host gaming machine, it can be advantageous to use the module as a temporary cache in order to prevent performance degradation of the gaming machine resulting from large data transfers. The module may store the downloaded data in a storage device, such as a hard drive, solid state memory, etc.

As noted above, these data may be transferred to the gaming machine or retained by the module. In some implementations, the storage device may serve as a temporary cache for software to be executed on the gaming machine. As noted above, some modules of the present invention are configured to run gaming machine software. Accordingly, a storage device of the module can provide longer-term storage for downloaded gaming machine software to be executed by the module and/or for content to be reproduced by the module.

Downloaded software may then be installed, if applicable, either on the gaming machine or the module (step 1230). For example, the module may notify the gaming machine that it is has downloaded software that is available for installation on the gaming machine. The gaming machine may notify the module when it is ready to receive the software. When the module receives the software request from the gaming machine, the module may download the software to the gaming machine.

After the module or the gaming machine has successfully received data and/or installed new software, the device may send an indication of such reception and/or installation. For example, the device may notify a server of the successful reception of the data and/or installation of the software from the server.

It may be desirable to segregate downloading operations. For example, it may be desirable to separate the downloading of software and the downloading of content into discrete operations. In one such example, a portable memory device may contain both content for reproduction by the module and software for execution by the gaming machine. Therefore, in step 1235 it is determined whether more data are available for evaluation. If so, the process returns to a previous step. For example, the process may return to step 1210, wherein the additional data may be evaluated. Alternatively, all of the data may have been previously evaluated and found to be desirable. If so, the process may return to step 1225 and the additional data may then be downloaded. If there are no additional data, the process ends (step 1240).

In other embodiments, controller module 1101 (see FIG. 11) may control a number of applications that utilize various other capabilities of the module, such as multimedia capabilities and peer-to-peer capabilities. For example, the multimedia capabilities are particularly advantageous for the reproduction of desired content. Peer-to-peer communication between different modules may allow different groups of modules to be linked and unlinked for cooperative or competitive game play, e.g. for class 2 game play. Details of such applications are described with respect to FIG. 11 of U.S. patent application Ser. No. 10/246,373, entitled "Player Tracking Communication Mechanisms In A Gaming Machine," which has been incorporated herein by reference for all purposes.

Figure 13:
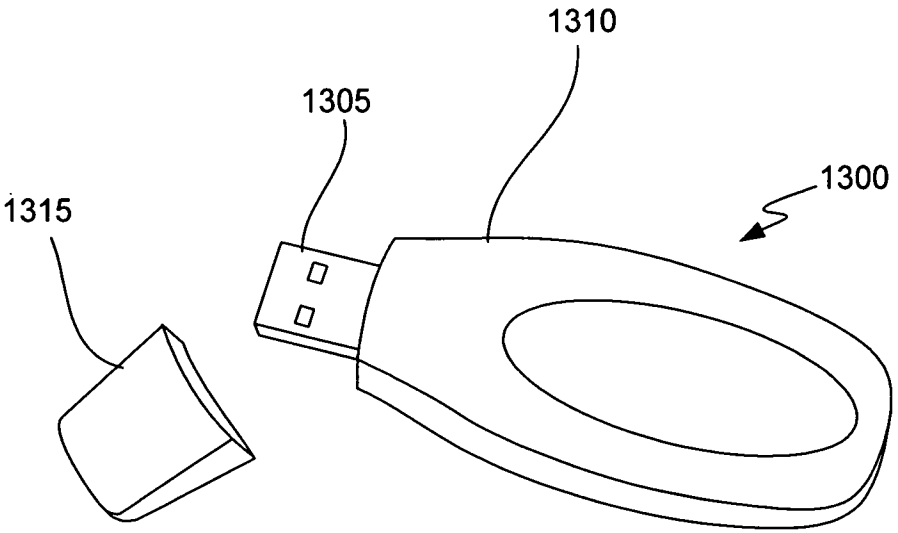
FIG. 13 illustrates one type of portable memory device that may be used in accordance with the present invention.

FIG. 13 illustrates one type of portable memory device that may be used in accordance with the present invention. Memory stick 1300 includes connector 1305, which in this example is configured for attachment to a USB port. Body portion 1310 includes a solid state memory encased in a protective shell. Cap 1315 protects connector 1305 and keeps connector 1305 clean when memory stick 1300 is not in use.

Some existing memory sticks have a storage capacity of up to 2 GB, are powered directly via a USB port and have write-protect and password protection. In some embodiments, memory stick 1300 includes a built-in fingerprint sensor for security and authentication, as described below with reference to FIG. 14.

Figure 14:
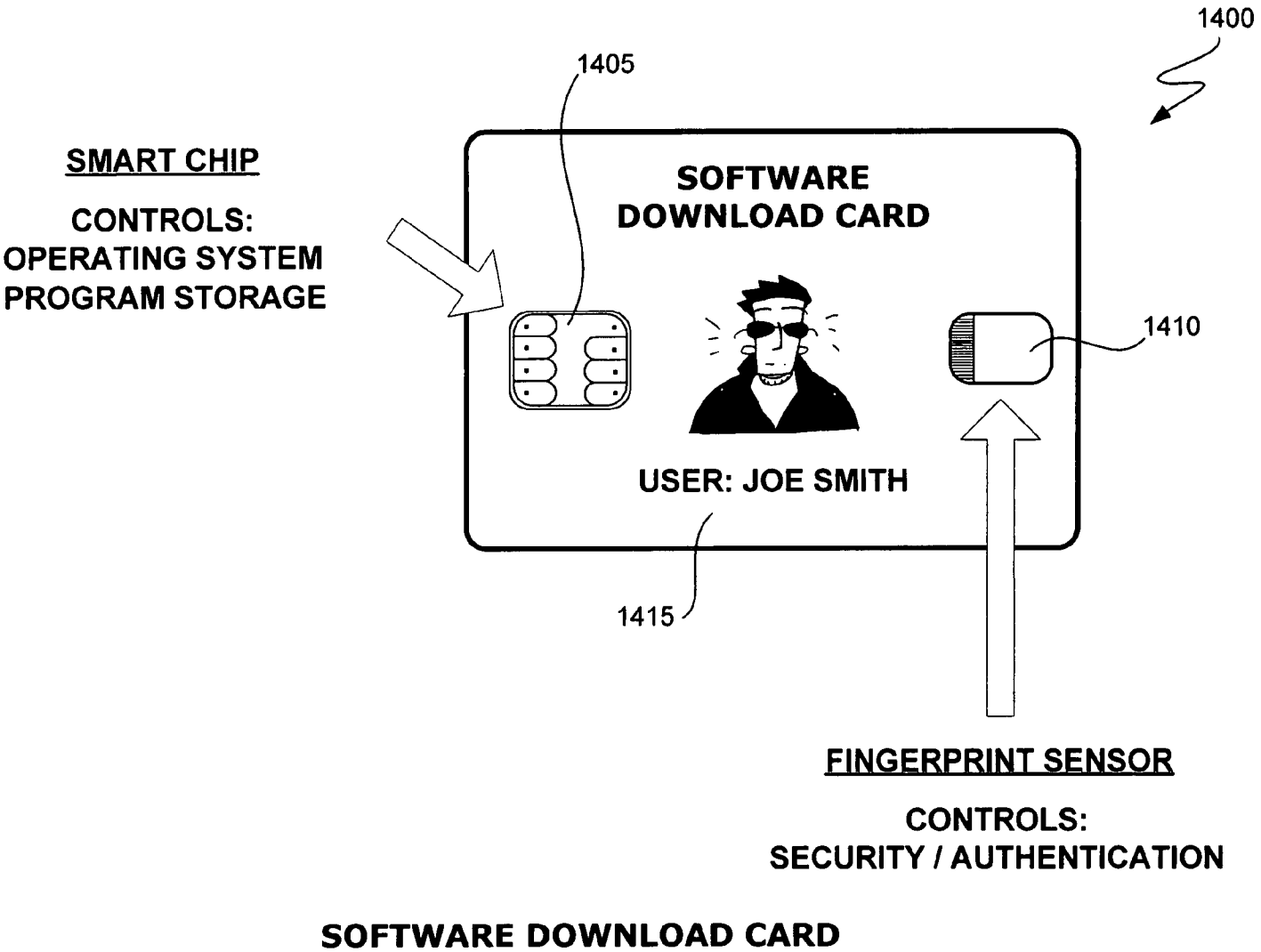
FIG. 14 illustrates one type of portable memory device that may be used in accordance with the present invention.

FIG. 14 illustrates a second type of portable memory device that may be used to implement some method of the present invention. Card 1400 is a type of "smart card." There are three general categories of smart cards: contact, contactless and hybrid or "combi" smart cards. A contact smart card requires insertion into a smart card reader with a direct connection to a conductive micromodule on the surface of the card (typically gold plated). It is via these physical contact points, that transmission of commands, data, and card status takes place. In this example, card 1400 is a contact smart card that is configured for insertion into a module's smart card reader.

In other embodiments, card 1400 is a contactless card that requires only close proximity to a reader. Both the reader and the card have an antenna and it is via this contactless link that the two communicate. Most contactless cards also derive the internal chip power source from this electromagnetic signal. The range is typically two to three inches for non-battery powered cards.

Some embodiments of card 1400 are combi cards or hybrid cards. A hybrid card has two chips, each with its respective contact and contactless interface. The two chips are not connected, but for many applications, this hybrid serves the needs of consumers and card issuers. Just emerging is the combi card which in a single chip card with a contact and contactless interface. With combi cards, it is possible to access the same chip via a contact or contactless interface, with a very high level of security.

Card 1400 includes chip 1405 for storing data, including any necessary software for implementing the functions of card 1400. Chip 1405 can be, for example, a microprocessor with internal memory or a memory chip with non-programmable logic.

The chips 1405 used in various embodiments of card 1400 fall into two general categories: microprocessor chips and memory chips. A memory chip can be viewed as a small floppy disk with optional security. Currently, memory cards can hold from 103 bits to 16,000 bits of data. They are less expensive than microprocessor cards but with a corresponding decrease in data management security. They depend on the security of the card reader for their processing and are ideal when security requirements permit use of cards with low to medium security.

A microprocessor chip can add, delete and otherwise manipulate information in its memory. It can be viewed as a miniature computer with an input/output port, operating system and hard disk. Microprocessor chips are currently available in 8, 16, and 32 bit architectures. Their data storage capacity ranges from 300 bytes to 32,000 bytes with larger sizes expected with semiconductor technology advances. Their ability to download not just data but applications is being advanced by Sun with JavaCard™ technology and by Mondex with Multos™.

JavaCard™ smart cards are based on Java technology from Sun Microsystems. Java is an object-oriented, platform-independent, multithreaded, programming environment. Java is the foundation for smart Web and networked services and allows for secure enterprise extension through platform independence. Different systems can talk to each other—from Java-based smart cards to supercomputers—regardless of the underlying hardware or system software.

Java is designed so that programs can be dynamically loaded over the network and run locally. A browser that can interpret Java bytecode (such as Netscape Navigator or Internet Explorer) can download and locally execute applets that are embedded in a Web page. In some embodiments, the activities of downloading and executing can be completely automatic, requiring no user approval for, or knowledge of, the process.

Chip 1405 may include the necessary data and software for implementing a biometric security system for verifying the identity of the user of a portable memory device. In this example, chip 1405 includes the necessary software for operating fingerprint sensor 1410. A fingerprint offers a reliable and inexpensive means of authenticating an individual's identity, one far more secure than personal identification numbers (PINs) or passwords which are subject to being compromised or forgotten. By linking the user directly to the transaction process through his or her fingerprint, proof is given that the authorized user is indeed present—not just someone who happens to know a short string of numbers or letters.

Fingerprint sensor 1410 may be of a type, for example, that has been engineered by companies such as Biometric Associates in Timonium, Md. and Fingerprint Cards AB in Stockholm, Sweden. These companies have produced a complete, embeddable fingerprint identification system that can be inserted into a variety of access devices requiring user authentication. Preferably, fingerprint sensor 1410 performs all sensor, processor and decision-making functions within the module, greatly simplifying the incorporation of biometric recognition into small, mass-produced products such as smart cards and RFID tokens.

One exemplary sensor includes a capacitive array sensor chip that detects and captures small variations in finger surface capacitance and creates a three-dimensional electrical image of the fingerprint's unique pattern. To enroll a user in the fingerprint identification system, one or more fingerprints of the authorized person must first be registered. This is accomplished in conjunction with an external enrollment station that activates and controls the process.

First, the user places his/her fingertip on the fingerprint sensor. It detects and captures the small variations in finger surface-capacitance and creates a three-dimensional electrical image of the fingerprint's unique papillary pattern. These signals are verified and then programmed under the control of the enrollment station into protected memory on the module. Upon completion of the enrollment process, the module is "locked" and subsequent placement of any finger on the sensor triggers the verification process. This involves comparing the previously stored "registered" template with the fingerprint image using a special programmed algorithm. In the case of a fingerprint-enabled smartcard, if the result matches, the person holding the card (not just someone who happens to know the PIN) is verified as its authorized user.

Although the foregoing invention has been described in some detail for purposes of clarity of understanding, it will be apparent that certain changes and modifications may be practiced within the scope of the appended claims. For example, in alternative embodiments, a laptop computer, cell phone or PDA can allow downloads by utilizing either an internal or external card reader tied to those devices.

Another method allows for player-activated bonusing through the module wherein the portable memory device is the "key" to allow special promotions, bonusing etc. to be displayed, e.g. by the module. In another embodiment, the use of a smart card provides a method of downloading plug-in multimedia content (such as advertisements) that has been developed via a Content Developers Kit. For example a gaming establishment could take data from external data sources (video clips, audio clips, text, configurable data, etc.) and translate them into a form understood by a module and/or a player tracking unit. This content would then be transferred to a smart card and inserted into a card reader of the module for download.

In addition, a portable memory device can be given to a player for special promotions or in a random way to allow for special bonusing or promotions. For example, players could be given smart cards upon exiting a casino show that provided for a specific content download into a module-equipped gaming machine. The download could be based on many different parameters that allow the player certain bonus opportunities that normally wouldn't be available.

In another embodiment, a biometric sensor (e.g., a fingerprint sensor) could be incorporated into another external device, such as a computer keyboard, a PDA, a cell phone or a standalone input unit. Biometric data stored on a portable memory device could be compared with biometric data obtained from the other external device in order to verify the identity of a person authorized to download data to the module.

The invention claimed is:

1. A wager-based gaming machine for providing game play of legacy wager-based games and native wager-based games, comprising:

a plurality of first peripheral devices including:

one of a coin acceptor and a bill validator for receiving cash or indicia of credit for wagers on games of chance, a display for presenting the games of chance, and a user input for receiving input from a player of the wager-based gaming machine;

a first processor for executing and providing games of chance on the wager-based gaming machine by controlling the first peripheral devices, wherein the native wager-based games are written for native execution by the first processor, and wherein the legacy wager-based games were written for execution by a gaming machine other than the wager-based gaming machine such that the legacy wager-based games include software code that is not natively executable by the first processor;

a software emulator for translating the legacy wager-based games to wager game software instructions that are natively executable by the first processor;

a hardware abstraction layer ("HAL") configured to emulate second peripheral devices of a second wager-based gaming machine for which the legacy wager-based games were written; and a logic device configured to enable or disable the software emulator based on a determination of whether or not the game being executed by the first processor is a legacy wager-based game or a native wager based game, and further configured to determine whether additional emulation software should be downloaded to the wager-based gaming machine based upon a comparison of a requirement of the legacy wager based games and a capability of the wager-based gaming machine.

2. The wager-based gaming machine of claim 1, wherein the wager-based gaming machine is operable in an emulation mode wherein the wager-based gaming machine can execute second wager game software instructions and also operable in a native mode wherein at least the software emulator is disabled.

3. The wager-based gaming machine of claim 1, wherein at least one of the first peripheral devices of the wager-based gaming machine is different from a corresponding second peripheral device of the second wager-based gaming machine.

4. The wager-based gaming machine of claim 1, wherein at least one of the first peripheral devices of the wager-based gaming machine has no counterpart second peripheral device of the second wager-based gaming machine.

5. The wager-based gaming machine of claim 1, wherein the HAL comprises a programmable logic device and wherein the HAL is thereby configurable to present a new peripheral device as a second peripheral device.

6. The wager-based gaming machine of claim 1, wherein the HAL comprises software embodied in a machine-readable medium.

7. The wager-based gaming machine of claim 2, wherein the logic device determines when the software emulator should be enabled or disabled based upon capabilities of the wager-based gaming machine.

8. The wager-based gaming machine of claim 2, wherein the logic device is further configured to determine whether the hardware abstraction layer should be enabled when the wager-based gaming machine is running in native mode.

9. The wager-based gaming machine of claim 1, wherein the logic device determines when the software emulator should be enabled or disabled based upon a header or a flag in the legacy wager-based games software code.

10. The wager-based gaming machine of claim 1, further comprising means for downloading the legacy wager-based games to the wager-based gaming machine.

11. The wager-based gaming machine of claim 1, further comprising means for downloading the additional emulation software to the wager-based gaming machine.

12. A gaming module, comprising:

a first port configured for communication with a network;

a physical interface configured for communication with a wager-based gaming machine, the gaming machine comprising:

a plurality of peripheral devices, the plurality of peripheral devices including at least one of a coin acceptor and a bill validator for receiving cash or indicia of credit for wagers on games of chance, a display for presenting the games of chance, and a a user input for receiving input from a player of the wager-based gaming machine, and a second physical central processing unit ("CPU"); and a first physical CPU included in the gaming module and configured for downloading games of chance from a game server via the first port, for executing the downloaded games of chance separately from the second physical CPU of the gaming machine, and for communicating with the peripheral devices of the gaming machine via the interface and via the second CPU of the gaming machine for presentation of the downloaded games of chance on the gaming machine that are executed by the first CPU, wherein the gaming module is a physical device configured to be coupled to the gaming machine, and wherein the games of chance are not compatible with the second CPU.

13. The gaming module of claim 12, further comprising an emulator for translating second game software instructions written for the second CPU to first game software instructions executable by the first CPU.

14. The gaming module of claim 12, further comprising a hardware abstraction layer.

15. The gaming module of claim 12, wherein the first CPU is further configured for enabling player tracking functionality.

16. The gaming module of claim 12, wherein the first CPU is further configured to control the second CPU to operate in a first game-executing mode or a second mode wherein the first CPU controls game execution.

17. The gaming module of claim 13, wherein the gaming module is operable in an emulation mode wherein the emulator is enabled and also operable in a native mode wherein the emulator is disabled.

18. The gaming module of claim 16, wherein the first CPU controls the second CPU to operate in the first game-executing mode when the first CPU determines that a desired game of chance was written to be executed by the second CPU.

19. The gaming module of claim 17, wherein a logic device determines when the emulator should be enabled or disabled based upon information in the second game software instructions.

20. The gaming module of claim 17, wherein a logic device determines when the emulator should be enabled or disabled based upon capabilities of the first CPU.

21. The gaming module of claim 19, wherein the logic device determines when the emulator should be enabled or disabled based upon a header or a flag in the second game software instructions.

22. The gaming module of claim 19, wherein the logic device determines when the emulator should be enabled or disabled based upon whether the second game software instructions are native game software executable by the first CPU.

23. A gaming system comprising:

a gaming module configured to be physically coupled to a wager-based gaming machine, the gaming module comprising:

a first port;

a first physical central processing unit ("CPU") included in the gaming module and configured for downloading games of chance from a game server via the first port and for executing the downloaded games of chance separately from a second physical CPU of the gaming machine, wherein the games of chance are not compatible with the second physical CPU; and a first random access memory ("RAM") device configured for communication with the first CPU, the first RAM device being configured to store the downloaded games of chance from the first CPU; and the gaming machine, comprising:

a plurality of peripheral devices including a device for receiving cash or indicia of credit for wagers on games of chance, the plurality of peripheral devices includes at least one of a coin acceptor and a bill validator, and a display for presenting the games of chance, and the second CPU; and wherein the second CPU is configured for communication with the plurality of peripheral devices, wherein the first CPU is configured for communicating with at least the display via the second CPU for presentation of the downloaded games of chance executed by the first CPU.

24. A gaming method, comprising:

receiving, from a user interface, an indication that a player desires to play a selected game of chance on a wager-based gaming machine, the wager gaming machine including a first physical CPU;

determining, using a logic device, that the selected game of chance was not written for the gaming machine and is not capable of being natively executed by the first physical CPU; and executing the gaming software with a second physical central processing unit ("CPU") included in a physical module, the physical module and the second physical CPU separate from the first physical CPU of the gaming machine, wherein the first physical CPU of the gaming machine is configured for communication with a plurality of peripheral devices of the gaming machine, wherein the plurality of peripheral devices includes at least one of a coin acceptor and a bill validator, and wherein the plurality of peripheral devices includes a main display configured to display the game of chance, and wherein the second CPU is configured for communication with at least the main display via the first CPU for presentation of the selected game of chance on the gaming machine that is executed by the second CPU.

25. The gaming method of claim 24, wherein the second CPU is configured to emulate the gaming machine for which the gaming software was written.

26. The gaming method of claim 24, further comprising:

downloading emulation software for emulating the gaming machine for which the gaming software was written.

27. The gaming method of claim 24, further comprising:

downloading the gaming software.

28. The gaming method of claim 24, further comprising:

determining that a feature of the gaming software is not allowed within a jurisdiction of the player; and disabling the feature.

29. The gaming method of claim 27, further comprising:

determining a protocol necessary to communication with a game server; and downloading the gaming software from the game server according to the protocol.

30. A gaming method, comprising:

receiving, by a user interface of a wager-based gaming machine, an indication that a player desires to play a selected game of chance on the gaming machine;

determining, by the gaming machine, that wager gaming software for the selected game of chance was not written for the gaming machine and cannot be natively executed by a processor of the gaming machine;

enabling a software emulator based on the determination that the wager gaming software was not written for the gaming machine;

determining that the software emulator of the gaming machine is not configured to emulate a gaming machine for which the wager gaming software was written;

downloading additional emulation software for emulating the gaming machine for which the wager gaming software was written; and executing the wager gaming software on the gaming machine with the processor through the additional emulation software.

* * * * *

UNITED STATES PATENT AND TRADEMARK OFFICE

CERTIFICATE OF CORRECTION

PATENT NO. : 8,888,600 B2
APPLICATION NO. : 11/205619
DATED : November 18, 2014
INVENTOR(S) : Binh Nguyen et al.

It is certified that error appears in the above-identified patent and that said Letters Patent is hereby corrected as shown below:

IN THE CLAIMS

In Claim 1, Column 35, Line 32, between “providing” and “games” insert --the--.
In Claim 8, Column 36, Line 20, between “in” and “native” insert --the--.
In Claim 12, Column 36, Line 40, delete the second instance of “a”.
In Claim 12, Column 36, Line 45, between “downloading” and “games” insert --the--.
In Claim 24, Column 38, Line 1, replace “wager” with --wager-based--.
In Claim 25, Column 38, Line 22, replace “the” with --a--.
In Claim 26, Column 38, Line 25, replace “the” with --a--.
In Claim 29, Column 38, Line 34, replace “communication” with --communicate--.

Signed and Sealed this
First Day of December, 2015

Michelle K. Lee

Michelle K. Lee
*Director of the United States Patent and Trademark Office*